US008991971B2

(12) United States Patent
Suzuki et al.

(10) Patent No.: US 8,991,971 B2
(45) Date of Patent: Mar. 31, 2015

(54) LIQUID EJECTING APPARATUS

(71) Applicant: Seiko Epson Corporation, Tokyo (JP)

(72) Inventors: Yuto Suzuki, Shiojiri (JP); Yoshisada Aoki, Azumino (JP); Masaki Shimomura, Matsumoto (JP); Nobutaka Suzuki, Shiojiri (JP); Seiji Tezuka, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/963,883

(22) Filed: Aug. 9, 2013

(65) Prior Publication Data

US 2014/0043392 A1 Feb. 13, 2014

(30) Foreign Application Priority Data

Aug. 10, 2012 (JP) ..... 2012-178149
Aug. 10, 2012 (JP) ..... 2012-178152

(51) Int. Cl.

| | |
|---|---|
| ***B41J 29/38*** | (2006.01) |
| ***B41J 2/015*** | (2006.01) |
| ***B41J 29/13*** | (2006.01) |
| ***B41J 2/135*** | (2006.01) |
| ***B41J 2/175*** | (2006.01) |
| ***B41J 19/20*** | (2006.01) |

(52) U.S. Cl.
CPC *B41J 2/135* (2013.01); *B41J 2/175* (2013.01); *B41J 19/20* (2013.01)
USPC ..... 347/20; 347/108

(58) Field of Classification Search
CPC ..... B41J 29/13; B41J 29/38; B41J 2/01
USPC ..... 347/16, 20, 108
See application file for complete search history.

(56) References Cited

U.S. PATENT DOCUMENTS

| | | | | |
|---|---|---|---|---|
| 8,727,519 | B2 * | 5/2014 | Nakagawa et al. | 347/92 |
| 2006/0044368 | A1 | 3/2006 | Kao | |
| 2007/0211131 | A1 * | 9/2007 | Iijima | 347/108 |
| 2007/0229565 | A1 * | 10/2007 | Imai | 347/16 |

FOREIGN PATENT DOCUMENTS

| | | |
|---|---|---|
| CN | 2825289 | 10/2006 |
| JP | 2005-199506 | 7/2005 |

(Continued)

OTHER PUBLICATIONS

International Search Report for PCT/JP2013/004406 dated Oct. 18, 2013.

*Primary Examiner* — Jason Uhlenhake
(74) *Attorney, Agent, or Firm* — Workman Nydegger

(57) ABSTRACT

A liquid ejecting apparatus includes a housing and a movement region of a carriage including a liquid ejecting head, an ink tank positioned at the outer side of the movement region of the carriage, an ink supply tubes connecting the ink tank and an adapter on the carriage, and a fixing portion fixing a portion of the ink supply tubes. In the housing, a containing unit of a sheet feeding cassette is formed to project to a discharge direction of a sheet and an operation panel unit is configured to have a housing portion having an inclined surface whose lower side further projects to the discharge direction than the upper side. The ink supply tubes have a deformable moving unit performing a movement of the carriage on a portion of a liquid ejecting head side rather than a fixing portion using a fixing tool.

10 Claims, 25 Drawing Sheets

(56) References Cited

FOREIGN PATENT DOCUMENTS

| | | |
|---|---|---|
| JP | 2007-030304 | 2/2007 |
| JP | 2008-074071 | 4/2008 |
| JP | 2009-072492 | 4/2009 |
| TW | 538909 | 6/2003 |

* cited by examiner

LIQUID EJECTING APPARATUS

BACKGROUND

1. Technical Field

The present invention relates to a liquid ejecting apparatus ejecting a liquid to a medium.

2. Related Art

In the related art, as a type of liquid ejecting apparatus, an ink jet printer has been known which performs a printing (recording) by ejecting an ink to a medium like a sheet from a liquid ejecting head. Then, in the printer, in order to continuously supply an ink to the liquid ejecting head in a stable manner when performing a relatively large amount of printing, a configuration is proposed in which the ink is supplied from an ink tank whose capacity of containing an ink is relatively large to an ink cartridge through an ink supply tube (for example, refer to Chinese Utility Model Registration No. 2,825,289).

In the printer having such a configuration, the liquid ejecting head is mounted on a carriage which is moveable in a scanning direction inside a main body housing. Then, the ink supply tubes extending from the ink tank provided outside the main body housing is inserted to a movement region of the carriage through an opening portion at the upper side of the main body housing to be connected to the ink cartridge mounted on the carriage. In this case, the ink supply tubes have the middle portion thereof in the longitudinal direction is fixed by a fixing member provided so as to cross an opening portion at the upper side of the main body housing, and accordingly a terminal portion of the ink supply tubes which is inserted to a movement region of the carriage is guided to the ink cartridge.

Incidentally, in the above-mentioned printer, since a fixing member as a dedicated member for fixing an ink supply tube is provided across an opening portion, there is a concern that the ink supply tubes fixed to the fixing member disturb a movement of a carriage.

SUMMARY

An advantage of some aspects of the invention is to provide a liquid ejecting apparatus which can inhibit a liquid supply tube from disturbing the movement of a carriage.

The invention can be realized in the following forms or application examples.

According to an aspect of the invention, there is provided a liquid ejecting apparatus, including a liquid ejecting head ejecting a liquid to a target, a housing unit where a carriage having the liquid ejecting head is moveably disposed and an opening portion exposing at least a portion of a movement region of the carriage is formed, a liquid containing unit positioned at the outer side of the movement region of the carriage in a state of containing the liquid, a liquid supply tube which is connected between the liquid containing unit and the liquid ejecting head and has a deformable moving unit performing a follow-up deformation along a movement of the carriage, a fixing portion fixing a portion of the liquid supply tube in a longitudinal direction to be relatively immovable with respect to the opening portion. The housing unit is configured to have a housing portion in which a tray accommodation unit, where a discharge tray receiving the target discharged from the inside of the housing unit is accommodated to be able to pull out, is formed to project to a discharge direction of the target, and a housing portion where an operation panel unit operated at a time of use has an inclined surface whose lower side further projects to the discharge direction side than the upper side at an upper position than the tray accommodation unit. The deformable moving unit is formed at a downstream portion serving as the liquid ejecting head side rather than the fixing portion in the liquid supply tube.

In this case, a portion of the liquid supply tube may be fixed to be relatively immovable with respect to an opening portion of the housing unit, so that it is possible to stably form the deformable moving unit performing a follow-up deformation along a movement of the carriage on between the opening portion and the liquid ejecting head. As a result, it is possible to inhibit the liquid supply tube from disturbing the movement of the carriage.

The above-mentioned liquid ejecting apparatus preferably further includes a feeding cassette unit provided in a state of projecting in the discharge direction with the housing portion, obtained by detachably containing a feeding cassette, which can contain the target, in the housing portion formed to project in a discharge direction of the target.

In this case, it is possible to inhibit the liquid ejecting apparatus from getting larger.

In the liquid ejecting apparatus, the fixing portion is preferably provided at a substantially central portion in a movement region of the carriage in a movement direction of the carriage.

In this case, since the deformable moving unit of the liquid supply tube has substantially the same tube length at both sides of a movement range of the carriage, the length of the liquid supply tube present between the fixing portion and the liquid ejecting head side may be inhibited to be the shortest.

The liquid ejecting apparatus preferably further includes a cover member rotatably supported by the housing unit and opening and closing the opening portion be included, and the fixing portion, in the housing unit, be provided on a side supporting the cover member with respect to the opening portion.

In this case, when the cover member opens the opening portion of the housing unit, a view field inside the opening portion is unlikely to be disturbed by the liquid supply tubes, so that it is relatively easy to identify the inner state through the opening portion.

In the liquid ejecting apparatus, it is preferable that a support member be further included which supports a portion of the liquid supply tube disposed in a state of projecting to the opening portion of the housing unit, and the fixing portion fix a portion supported by the support member in the liquid supply tube, and the support member be provided so as to be displaceable in a movement direction of the carriage.

In this case, by displacing the support member in a direction away from the substantially central position of the opening portion of the housing unit, a user may easily insert the finger to the movement region of the carriage through the opening portion of the housing unit. Therefore, even if the carriage is in the middle position of the movement region, for example, it is possible to relatively easily perform maintenance of the carriage or a processing of a jam of a target.

In the liquid ejecting apparatus, it is preferable that one end side of the support member in a longitudinal direction be attached to be rotatable with respect to the housing unit.

In this case, by rotating the support member with respect to the housing unit, it is possible to easily realize a configuration where the support member may be displaced in a direction away from the substantially central position of the opening portion of the housing unit.

In the liquid ejecting apparatus, it is preferable that, in the liquid supply tube, a plurality of tubes be connected to each other through a joint connecting between tubes.

In this case, by connecting a plurality of tubes, it is possible to adjust an optimal length to pull around the liquid supply tube.

In the liquid ejecting apparatus, it is preferable that the liquid supply tube be provided one or more than one.

In this case, using the liquid supply tube of the number corresponding to the number of the liquid containing unit, it is possible to provide a liquid from each liquid containing unit to the liquid ejecting head.

In the liquid ejecting apparatus, it is preferable that the liquid containing unit be positioned at the outer side of the housing unit.

In this case, restrictions on the containing amount of liquid are eased in the outer side of the housing unit, so that it is possible to include a liquid containing unit which may contain a relatively large amount of liquid.

In the liquid ejecting apparatus, the liquid containing unit positioned at the outer side of the housing unit in a state of containing the liquid ejected by the liquid ejecting head contains a black liquid.

In this case, the black liquid is consumed a lot, so that a capacity to contain the black liquid increases.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, as a first embodiment of a liquid ejecting apparatus, an ink jet type printer is described referring to drawings, which includes a liquid ejecting head ejecting an ink as an example of liquid and prints an image including characters, graphics and the like by ejecting the ink to a sheet as an example of a target.

Figure 1:
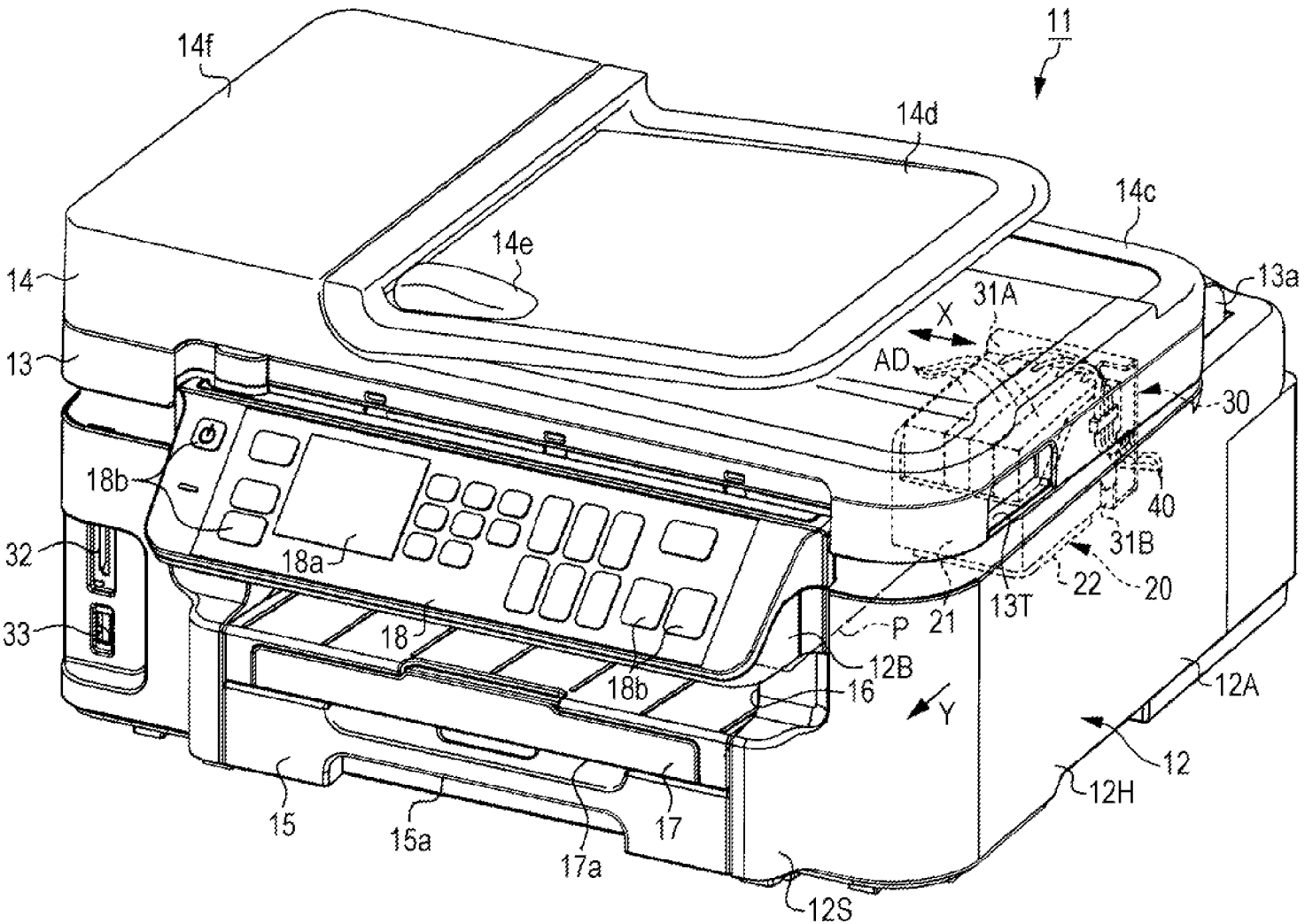
FIG. 1 is a perspective view illustrating a printer according to a first embodiment.

As illustrated in FIG. 1, a printer 11 of the present embodiment includes a printing function unit 12A (printer unit) made of an apparatus main body 12 having a printing function, and an image reading unit 13 (scanner unit) having a scan function on the upper side of the apparatus main body 12, and is so-called a multifunction machine. In the following description, the printer made of the multifunction machine is referred to as a printer 11.

The printer 11 is provided with an ink through ink supply tubes 40 (refer to FIG. 3) disposed by a fixing portion from an ink tank 19T (refer to FIG. 3) as an example of a liquid containing unit having a rectangular parallelepiped shape as a separate body.

In the printer 11, a printing function unit 12A as an example of a housing unit embedded with a printing unit 20 is disposed on a lower portion side which is the gravity direction thereof, and an image reading unit 13 as an example of a cover member embedded with an image reading mechanism such as a scanner and the like reading a manuscript (image) is disposed on the upper portion side which is a counter-gravity direction. The image reading unit 13 rotates (displaces) about a hinge 13*a* provided at one side end (rear side) of the apparatus main body 12, and the hinge 13*a* is configured to have the front side of the opposite side lifting. That is, on a housing side surface (both left and right side surface) of the image reading unit 13, a hand grip portion 13T is provided to be concaved, and a user of the printer 11, for example, may raise the image reading unit 13 by putting a hand in the hand grip portion 13T during maintenance. By the raising, an opening portion 12K (refer to FIG. 3), exposing at least a portion of the movement region of the carriage 21 disposed so as to reciprocate in the printing function unit 12A (that is, apparatus main body 12), is exposed.

Furthermore, an automatic manuscript supply device (auto document feeder) automatically providing a reading manuscript to the image reading unit 13 is disposed at the upper side of the image reading unit 13. The automatic manuscript supply device 14 rotates about the hinge 14*a* (refer to FIG. 2) provided at one side end (at rear side) of the apparatus main body 12 so that the hinge 14*a* has the front side of the opposite side lifting. By the lifting of the automatic manuscript supply device 14, the manuscript stand 13*b* (refer to FIG. 2) formed on the upper surface of the image reading unit 13 is exposed, so that a user may manually supply a read manuscript with respect to the image reading unit 13.

Here, the automatic manuscript supply device 14 includes a manuscript tray 14*d* for setting a manuscript on the upper side of a main body 14*c* in a rectangular plate shape, and on the manuscript tray 14*d*, a guide member 14*e* for positioning a document in the width direction is provided. The document set on the manuscript tray 14*d* is fed onto a document table 13*b* of the image reading unit 13 one by one by an operation of a feed mechanism unit 14*f* disposed on the left side in the FIG. 1, and discharged onto the main body 14*c* after reading the document image.

In addition, at the lower portion of the apparatus main body 12, a sheet feeding cassette 15 which may contain a plurality of overlapped sheets P is detachably provided. A sheet P contained in the sheet feeding cassette 15 is fed one by one toward the front from the rear of the printing unit 20 provided in the printing function unit 12A, and the printing unit 20 performs printing on the fed sheet P. That is, the sheet P fed from the sheet feeding cassette 15 is transported to the printing unit 20 by a transportation mechanism having rollers 24, 25, and the like to be described below. In the printing unit 20, an ink is ejected to the sheet P from a liquid ejecting head 22 reciprocating by a moving mechanism along a direction referred to as main scanning direction X) intersecting with the transportation direction (referred to as a sub-scanning direction Y) of the sheet P, and an image and the like are printed on the sheet P. The printed sheet P where printing is finished by the printing unit 20 is discharged (discharge paper) from a sheet discharge port 16 provided at the front surface of the apparatus main body 12 (printing function unit 12A).

In the apparatus main body 12 (printing function unit 12A), on the upper side of the sheet feeding cassette 15 and the lower side of the sheet discharge port 16, a stacker 17 as an example of a discharge tray, which receives the sheet P discharged from the sheet discharge port 16, is accommodated. The stacker 17 is used by the length being pulled out from the main body 12 corresponding to the size of the discharged sheet P.

A containing unit 12S having a containing concave portion where the sheet feeding cassette 15 and the stacker 17 are contained at a center portion in a width direction is configured to have a housing portion formed to project to a discharge direction of the sheet P (here, a sub-scanning direction Y). Projecting the containing unit 12S is because the length of the sheet feeding cassette 15 in a sub-scanning direction Y is longer than the length of the housing 12H in the sub-scanning direction Y, which is needed in the printing unit 20. Therefore, the sheet feeding cassette 15 and the stacker 17 are contained so as to align the front end surface to the containing unit 12S in a state of projecting from the apparatus main body 12 in the sub-scanning direction Y (frontward). Specifically, when the length of the apparatus main body 12 in the sub-scanning direction Y is determined according to the length of the sheet feeding cassette 15 in the sub-scanning direction Y which is needed so as to contain the sheet P of a predetermined size (for example, A4), since the apparatus main body 12 gets larger (increase in the lower surface area), in order to avoid this even a little, only a containing unit part of the sheet feeding cassette 15 is allowed to project. In other words, by gouging out both sides of the containing unit 12S containing the sheet feeding cassette 15, a portion of the sheet feeding cassette 15 and the containing unit 12S is allowed to project frontward. In addition, the front surface position during accommodating the stacker 17 according to the projecting front surface position of the sheet feeding cassette 15, so that a projection length when pulling out the stacker 17 is ensured to be relatively long. Furthermore, by the projection, the stacker 17 is made to be easily pulled out from the apparatus main body 12 by a grip portion 17*a*. Thus, the sheet feeding cassette 15 is detachably provided at the front surface of the apparatus main body 12, compared to a configuration enabling the sheet to be supplied from the front surface side of the apparatus main body 12, the printer 11 is relatively inhibited from getting larger (particularly, increase in the lower surface area of a printer). The containing unit 12S configures a tray accommodation unit where the stacker 17 is contained to pull out.

On the other hand, as illustrated in FIG. 1, an operation panel unit 18 for performing various types of operations such as performing printing on the printing unit 20 is disposed at a position upper than the sheet discharge port 16 in the apparatus main body 12 (printing function unit 12A). A base portion 12B of an operation panel unit 18 is configured to include a housing portion having an inclined surface whose lower side further projects to a discharge direction (that is, the sub-scanning direction Y) of the sheet Y than the upper side. Then, on the inclined surface of the base portion 12B, a display unit 18*a* for displaying a menu screen and the like (for example, liquid crystal display) and an operation button 18*b* are attached. In the operation button 18*b*, for example, a power button, a selection button selecting a desired item from the menu screen, and a printing start button for instructing the start of the print are provided. The operation panel unit 18 is formed to be an inclined surface which projects to the front of the apparatus main body 12 and has a display surface and the operation surface descending forward, so that the visibility of the display unit 18*a* and operability of the operation button 18*b* is well ensured by a user.

Now, the printing unit 20 including the printer 11 according to the present embodiment includes a liquid ejecting head 22 which has a carriage 21 as an example of a moving body reciprocating in a main scanning direction X, and ejects an ink to the carriage 21. The carriage 21 is guided by a guide frame 30 which is a plate member extending along the main scanning direction X, and disposed to be moveable (reciprocate) in the main scanning direction X. The guide frame 30 has an upper rail 31A and a lower rail 31B formed by a member bent in a substantially U-shape at both upper and lower side end portions of a plate member orthogonal to the main scanning direction X. The carriage 21 reciprocates in the main scanning direction X in a state where the rear end side is supported by the upper rail 31A and the lower rail 31B. Then, an ink provided through the ink supply tubes 40 from the ink tank 19T (refer to FIG. 3) is ejected from the liquid ejecting head 22 included in the reciprocating carriage 21, thereby performing printing on the sheet P.

The carriage 21 has a substantially rectangular box shape whose upper part is open, and on a mounting portion in a concave shape on the upper portion, an adapter AD relaying an ink provided through the ink supply tubes 40 to the liquid ejecting head 22 is mounted. An ink is provided from the adapter AD mounted on the carriage 21 to the liquid ejecting head 22. Therefore, the ink supply tubes 40 connected to the adapter AD forms a portion of an ink flow path in which an ink may flow between the ink tank 19T and the liquid ejecting head 22.

Color printing is available in the printer 11 of the present example, and in the adapter AD in an example of FIG. 1, a plurality of ink colors (for example, four) the same as the number of ink colors (for example, four) required in color printing are mounted. Of course, by mounting only a black color adapter AD, it is possible to use the printer 11 as a monochrome print-ready printer. In addition, the carriage 21 can be used with an ink cartridge mounted thereon, and the adapter AD has a rectangular plate shape adjusted to the shape and the size of the ink cartridge corresponding to the printer 11. However, the ink volume is less than the ink cartridge, so that the shape and the size of the adapter AD may be appropriately changed within a range where the adapter AD may be mounted on a mounting portion of the carriage 21.

In addition, as illustrated in FIG. 1, at the front surface left side end portion of the apparatus main body 12, a slot 32 for inserting a card such as a memory card or a communication card, and a communication port 33 (connector) corresponding to a predetermined communication method, for example, USB communication and the like are provided. In the printer 11, printing based on data received from the host device through USB communication, and photo printing performed by reading the image data such as photographs from the memory card are possible.

Figure 2:
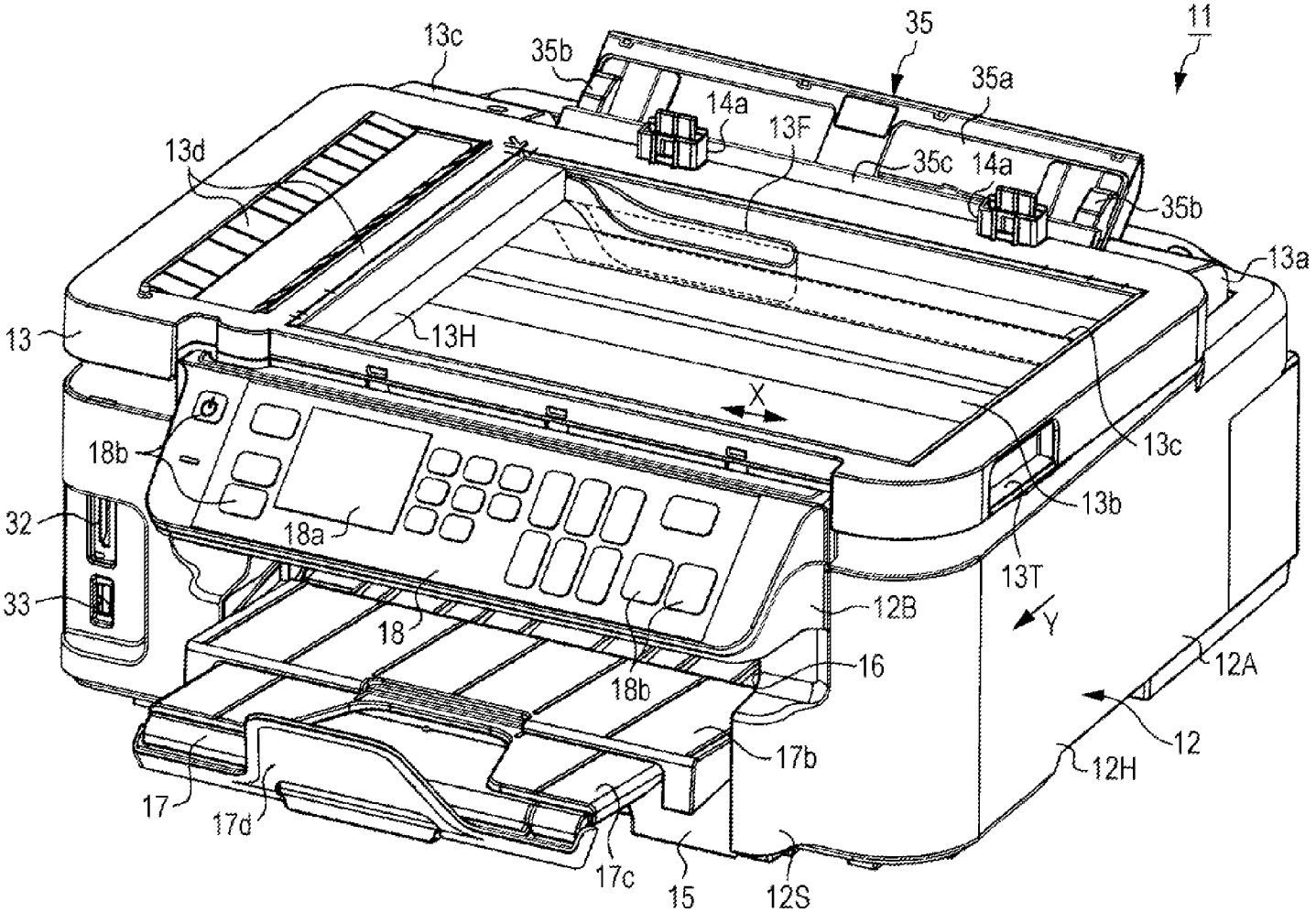
FIG. 2 is a perspective view illustrating the printer in a state of opening a stacker and a manual sheet feeding mechanism.

FIG. 2 illustrates the printer 11 in a state where an automatic manuscript supply device 14 is removed. In a state where the automatic manuscript supply device 14 is open, a manuscript stand 13*b* of the image reading unit 13 illustrated in FIG. 2 is exposed, at a position lower than the reading surface (glass surface), a long reading head 13H of a long shape in the sub-scanning direction Y is provided to be moveable in the main scanning direction X. At the bottom portion of the image reading unit 13, a concave groove 13*c* where a flexible flat cable 13F (hereinafter, referred to as 'FFC 13F') connected to one end portion of the reading head 13H is contained is formed so as to extend in the main scanning direction X. The FFC 13F moves in the concave groove 13*c* to follow when the reading head 13H moves in the main scanning direction, and accordingly the reading head 13H may transmit a manuscript reading signal to a controller (not illustrated) in the printer 11 through the FFC 13F in the entire region of the movement path. In addition, in the adjacent position of the manuscript stand 13*b* on the upper surface of the image reading unit 13, a transporting surface 13*d* of the sheet fed from the automatic manuscript supply device 14 is formed.

In addition, as illustrated in FIG. 2, on a back surface side of the apparatus main body 12 (printing function unit 12A), a manual sheet feeding mechanism 35 is embedded. The manual sheet feeding mechanism 35 is a mechanism feeding one sheet P manually set by a user. The manual sheet feeding mechanism 35 includes a sheet feeding tray 35*a* in a substantially rectangular plate shape, a pair of sheet guides 35*b* operated when positioning the sheet P on the sheet feeding tray 35*a* in the width direction, and a protective plate 35*c* provided on a purpose of preventing debris and the like from falling to a feeding port (not illustrated) in an opening state of the manual sheet feeding mechanism 35. The sheet feeding tray 35*a* is provided to rotate about the base end portion in a predetermined angle range (a lower end portion in FIG. 2), and disposed at an opening position illustrated in FIG. 2 which has an inclined posture in which the sheet P may be set, and a closing position rotated from the opening position to the front side of FIG. 2 and accommodated in the apparatus main body 12. The protective plate 35*c* is biased to a direction accessing the sheet feeding tray 35*a* by an elastic force of the torsion coil spring (not illustrated), and when opening the sheet feeding tray 35*a*, a lower portion region of the sheet feeding tray 35*a* is disposed at predetermined intervals (for example, 3 to 10 mm) and disposed at a protective position illustrated in FIG. 2 preventing debris from entering the feeding port.

In addition, the stacker 17 includes a first tray 17*b*, a second tray 17*c*, and a third tray 17*d* in a three stage form, as an example. The first tray 17*b* is slidably connected with the apparatus main body 12, and the second tray 17*c* is slidably connected with the first tray 17*b*. Then, the third tray 17*d* is rotatably connected to a front end portion of the second tray 17*c*, and disposed at a closing position where the third tray 17*d* is accommodated in a state of overlapping with respect to the second tray 17*c*, and an opening position functioning as a stopper of the sheet before rising upward at a predetermined angle as illustrated in FIG. 2.

Figure 3:
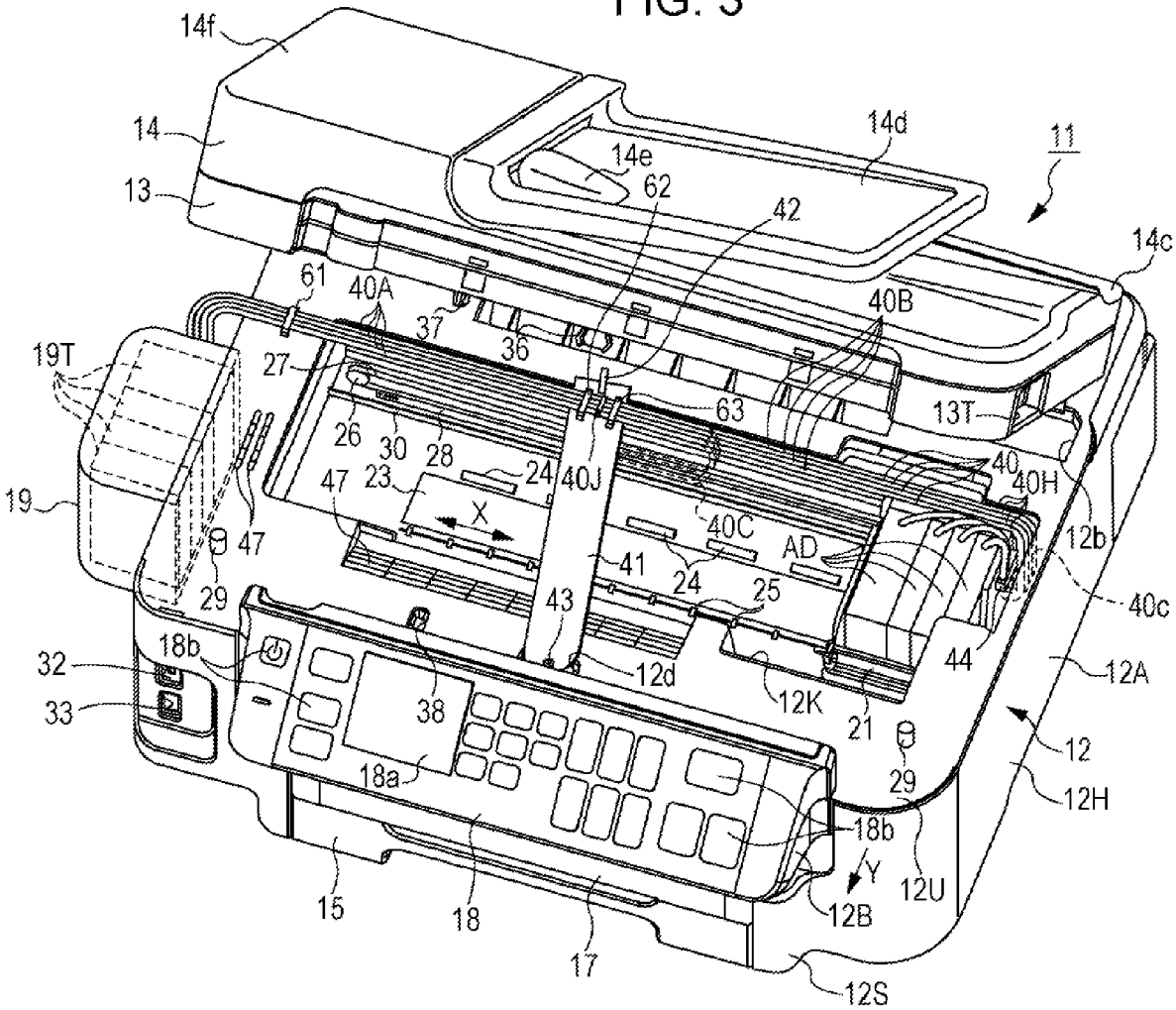
FIG. 3 is a perspective view illustrating the printer in a state of closing an image reading unit.

Next, a configuration of a printing unit 20 will be simply described using FIG. 3. As illustrated in FIG. 3, in the housing 12H, at a position opposite to the lower surface (nozzle formation surface) of the liquid ejecting head 22 (refer to FIG. 1) provided at the lower portion of the carriage 21, a support stand 23 in a long shape extending along the main scanning direction X is disposed. At each position at upstream side and downstream side interposing the support stand 23 in the sub-scanning direction Y, a transportation roller 24 and a sheet discharge roller 25 are disposed. The sheet P contained in the sheet feeding cassette 15 is in contact with a pickup roller on the upper surface, which is not illustrated. The pickup roller rotates, and accordingly the most upper sheet among the sheet P is sent out in a path through the rear side, the sheet P sent out has the path inverted to the sub-scanning direction Y along the outer peripheral surface of the feeding roller (not illustrated), and thereafter when the sheet P reaches the transportation roller 24, the sheet P is fed onto the support stand 23 by rotation of the transportation roller 24.

In addition, in the housing 12H, a timing belt 27 in an endless shape wound around the pair of pulley 26 is arranged along a guide frame 30 disposed on the back surface side of the carriage 21, and the back surface portion of the carriage 21 is fixed to a portion of the timing belt 27. At the lower side of the timing belt 27, a linear encoder 28 extending in parallel to the timing belt 27 is provided, and a position of the carriage 21 is detected based on the detection signal.

When a carriage motor where the output shaft is connected to a pulley 26 and which is not illustrated is driven forwardly and reversely, the timing belt 27 rotates forwardly and reversely and the carriage 21 reciprocates in the main scanning direction X along rails 31A and 31B. Then, during movement of the carriage 21, by alternately performing a recording operation ejecting an ink from the liquid ejecting head 22 and performing a recording of one row (one pass) on the sheet P and a transportation operation transporting the sheet P to a next recording position, documents, images, or the like are printed on the sheet P. At that time, according to a carriage position detected based on a detection signal of the linear encoder 28, ejection or non-ejection of an ink for every nozzle of the liquid ejecting head 22 is controlled.

An ink used by the liquid ejecting head 22 in the printing is provided to the liquid ejecting head 22 through each ink supply tubes 40 and each adapter AD from each ink tank 19T in an external tank unit 19. In the tank unit 19 of the example, four ink tanks 19T each containing four different color inks as an example are contained. As these four colors, for example, black (K), cyan (C), magenta (M), and yellow (Y) are mentioned. In an example of FIG. 3, among four ink tanks 19T, one containing a black ink which has comparatively large ink consumption amount is a wide large tank, and three for color each containing three color inks are small narrow tanks.

In addition, in the adapter AD which is mountable on the carriage 21, according to the shape and the size of an ink cartridge of a corresponding ink color, one for black ink is thick, and one for color ink has a thickness thinner than the one for black ink. When the carriage 21 has a plurality (four) of ink cartridge mounting concave portions, and the adapter AD is mounted on these mounting concave portions, a terminal of the back surface is in contact with a terminal of the carriage 21 side.

Next, the configuration of the first embodiment according to a fixing portion fixing the ink supply tubes 40 will be described referring to FIGS. 3 to 5. The fixing portion of the first embodiment has a configuration of fixing the ink supply tubes 40 using a fixing tool to the housing 12H forming the opening portion 12K. As the fixing tool, it is possible to use various members such as string, rubber bands, clips, adhesive tape, adhesive or the like. In addition, the present embodiment is described by using an adhesive tape as an example of the fixing tool. In addition, in description of FIGS. 3 to 5, configuration members the same as those in FIG. 1 are given the same reference numbers, and the description is appropriately omitted.

As illustrated in FIG. 3, the ink tank 19T is disposed at the outside of the movement region of the carriage 21, and particularly disposed at the outside of the housing 12H. The ink tank 19T, when viewed from the front side of the printer 11 (the front side in the sub-scanning direction Y), is disposed at the left outside of the housing 12H, that is, a position opposite to a home position in the main scanning direction X. Then, one end portion of the ink supply tubes is connected to the ink tank 19T, and an opposite side portion of the ink supply tubes 40 is inserted in a movement region of the carriage 21 exposed through the opening portion 12K provided in the housing 12H from a position close to the home position in the main scanning direction X of the carriage 21. The other inserted end portion is connected to the adapter AD mounted on the carriage 21. Specifically, one end portion of the ink supply tubes 40 is connected to a discharge tube (not illustrated) provided in a state of being in communication with the ink tank 19T at the lower portion of the tank unit 19, and the other end portion is connected to a supply tube (not illustrated) on the upper surface of the adapter AD mounted on the carriage 21. Each ink supply tube 40 connected between the tank unit 19 and the adapter AD on the carriage 21, in a case where the hinge 13*a* side rotatably supporting the image reading unit 13 is set to the rear side, the upside of the rear side portion of the opening portion 12K is built to be substantially straightly extended in the main scanning direction X.

As illustrated in FIG. 3, on the upper surface of the housing 12H, so as to cross-cut the opening portion 12K in the sub-scanning direction Y, a support plate 41 in an elongated plate shape is provided as an example of a support member. The length of the support plate 41 in a longitudinal direction is slightly longer than the width of the opening portion 12K in the sub-scanning direction Y. On the upper surface portion 12U of the housing 12H, at a position corresponding to a locking projection 36 projected at a substantially central position of the inner surface front end portion of the image reading unit 13 in the width direction, a locking concave portion 12*d* to be locked with the locking projection 36 are provided to be concaved with the image reading unit 13 closed. One end portion of the support plate 41, using a screw hole (not illustrated) formed to fix a locked member (not illustrated) to the lower surface of the locking concave portion 12*d*, has a screw 43 slightly projecting from the upper surface of the housing 12H to the screw hole or screwed in a hole of the end portion of the support plate 41, and is rotatably supported around the screw 43. Therefore, by rotating the support plate 41 in a surface parallel to the opening surface of the opening portion 12K around the screw 43, an angle formed between the longitudinal direction of the support plate 41 and the main scanning direction X is changeable, so that it is possible to adjust a fixed position of a portion of the ink supply tubes 40 on the support plate 41.

Then, in a state where an angle of a position fixing a portion of the ink supply tubes 40 is adjusted, an end portion (free end) of the rotation front end side of the support plate 41 is fixed to the upper surface portion 12U of the housing 12H by the fixing tool 42. The fixing tool 42 may be, for example, an adhesive tape. Of course, the fixing tool 42 may also be a screw, an adhesive or the like. At a position slightly apart from the left of the locking concave portion 12*d* on the upper surface portion 12U of the apparatus main body 12, a detected concave portion 38 is formed where the projection 37 provided on the inner surface is inserted when closing the image reading unit 13. In addition, a ventilating port 47 is formed around the opening portion 12K on the upper surface portion 12U of the housing 12H.

In addition, at a further rear position than the opening portion 12K on the upper surface portion 12U of the housing 12H, at a position corresponding to a projection unit projecting at a point on the rear surface side corresponding to the concave groove 13*c* of the image reading unit 13, a concave portion 12*b* where the projection unit is contained is formed. As illustrated in the embodiment, in a configuration of pulling the ink supply tubes 40 around the upper surface portion 12U of the housing 12H, it is desirable to route the ink supply tubes 40 avoiding the concave portion 12*b* where the projection unit is contained.

Moreover, on the upper surface of the housing 12H, a boss 29 in a substantially cylindrical shape is fixed in a state of projecting upward at a predetermined length. That is, the boss 29, when rotating the image reading unit 13 in a closing direction to close the opening portion 12K, is interposed between the printing function unit 12A and the image reading unit 13, and accordingly, between the image reading unit 13 and the printing function unit 12A, is provided so as to ensure a void through which the ink supply tubes 40 are inserted. In FIG. 3, in order to stably form the void, two bosses 29 are provided, but the boss 29 may be one.

The middle portion in the longitudinal direction of the ink supply tubes 40 inserted through the void formed by the boss 29 is fixed to the upper surface portion 12U of the housing 12H by a first fixing tool 61 (for example, adhesive tape). In the present embodiment, for example, it is described that the middle portion is fixed using a plurality of fixing tools (three adhesive tapes in FIG. 3). Of course, a fixing tool is used as many as required to fix the ink supply tubes 40.

Specifically, the ink supply tubes 40 first extends from the tank unit 19 where a plurality of ink tanks 19T are contained in a tank case, and fixed to a portion disposed on the upper surface portion 12U extending in the main scanning direction X from the left side surface slightly back side in FIG. 3 of the apparatus main body 12 by the first fixing tool 61. Next, the middle portion on the downstream side which is a connection side further to the adapter AD in the ink supply tubes 40 is sequentially fixed by a second fixing tool 62 and a third fixing tool 63 with respect to the support plate 41.

In addition, as illustrated in FIG. 3, an adapter AD close portion in the ink supply tubes 40 is held in a state of being bundled by a holding member 44 fixed to a right side surface in FIG. 3 of the carriage 21, and an end portion on a further downstream side than a position bundled by the holding member 44 is connected to a supply tube (not illustrated) on the upper surface of the adapter AD, respectively.

The middle portion of the ink supply tubes 40 fixed by the first to the third fixing tools 61, 62, and 63 is controlled to move in a length direction of the ink supply tubes 40 and a direction intersecting with the length direction.

Therefore, the first to the third fixing tools 61, 62, and 63 fixing the middle portion of the ink supply tubes 40 function as an example of the fixing portion.

Then, in the embodiment, among the first to the third fixing tools 61, 62, and 63, the third fixing tool 63 (for example, adhesive tape) fixing the middle portion of the most downstream side with respect to the housing 12H of the ink supply tubes 40 is a fixing portion fixing a portion of the ink supply tubes 40 in the length direction to be in a state where relative movement with respect to the opening portion 12K is not possible. As a result, a portion between the third fixing tool 63 and the adapter AD in the length direction of the ink supply tubes 40, more accurately, a portion between the third fixing tool 63 and the holding member 44 is a deformable moving unit 40H deformed according to a movement of the carriage 21 as illustrated in FIG. 3. That is, a tube length of the deformable moving unit 40H is stipulated by a fixed position of a fixing tool of FIG. 3.

Here, the deformable moving unit 40H is briefly described. The ink supply tubes 40 displayed by a solid line in FIG. 3 is one when the carriage 21 is positioned in a home position, and a curved portion 40C of the ink supply tubes 40 when the carriage 21 is positioned at a reverse home position is displayed by double dashed line in the same figure. In an example of FIG. 3, a plurality of ink supply tubes 40 is disposed in a surface shape by being arranged substantially in a line in a radial direction so that the central line thereof may be substantially positioned on the same surface. Then, the plurality of ink supply tubes 40 is curbed in a cylindrical surface shape in the middle, and both side portions (tube surface) interposing the curved portion are disposed so as to face each other in a vertical direction and extend substantially in parallel.

When the carriage 21 is moved, the curved portion 40C of the ink supply tubes 40 moves at a movement distance (in order words, movement speed) of about half of the movement distance (that is, movement speed) of the carriage 21 in a carriage movement direction. At this time, in a course where the carriage 21 moves from the home position to the reverse home position, the ink supply tubes 40 follow a movement of the carriage 21 while moving the curved portion 40C to the left in FIG. 3. The ink supply tubes 40 deform the curved portion 40C while changing a position of the curved portion 40C in the main scanning direction X during a movement course of the carriage 21. Therefore, the ink supply tubes 40 in a movement course of the carriage 21 is neither bent nor broken. Accordingly, even during the movement of the carriage 21, it is possible to smoothly supply an ink to the adapter AD on the carriage 21 through the ink supply tubes 40. In addition, the ink supply tubes 40 are broken and in contact with the sheet P or a roller 24 of a transport system, a timing belt 27 or the like, thereby it is easy to avoid a situation where a defective printing is incurred.

As illustrated in FIG. 3, the carriage 21 moves from a position where the curved portion 40C is closest to the carriage 21 (home position in FIG. 3) to a position where the curved portion 40C is most apart from the carriage (reverse home position). In a course where the carriage 21 entirely moves a movement region, a portion contributing to the formation of the curved portion 40C in the ink supply tubes 40 is a deformable moving unit 40H. Then, in a position of the curved portion 40C (a position of the curved portion 40C illustrated by double dashed line in FIG. 3), a portion on further upstream side in an ink supply direction than the curved portion 40C is non-moving portion which does not contribute to the formation of the curved portion. Here, the boundary portion between the deformable moving unit 40H and the non-moving portion may be fixed by the fixing portion. However, in the embodiment, in order to have some room, a portion of the ink supply tubes 40 is fixed to a position on further upstream side than the boundary portion by a predetermined distance. For example, it is preferable that the predetermined distance be set to a value which is equal to or lower than a distance of a longer one of a distance corresponding to 30% of the tube length of the deformable moving unit 40H and 5 cm. When fixing the ink supply tubes 40 at a position far exceeding a predetermined distance from the boundary portion to the upstream side, this is to avoid as much as possible a situation where a portion which does not contribute to formation of curved portion becomes long and the shape maintenance of the deformable moving unit 40H is unstable and a tube portion forming the deformable moving unit 40H is broken. Of course, a portion fixing the ink supply tubes 40 using the third fixing tool 63 (for example, adhesive tape) may be a boundary portion or a portion exceeding a predetermined distance from the boundary portion to an upstream side.

Then, in the embodiment, the third fixing tool 63 fixes a portion on the upstream side of the ink supply tubes 40 instead of a substantially central portion in the movement region of the carriage 21. Therefore, the ink supply tubes 40 have the left side portion a little shorter than the right side portion in FIG. 3, and both sides of a movement range of the carriage 21 centered on the fixing portion have the substantially the same length. In the embodiment, a portion between the boundary portion of the ink supply tubes 40 and a non-moving portion and the holding member 44 is the deformable moving unit 40H.

Incidentally, as shown in FIG. 3, in the embodiment, it is preferable that the ink supply tubes 40 be configured to have a plurality of tubes 40A and 40B connected through a joint 40J in the longitudinal direction. The joint 40J is provided in a plurality of locations according to the number of tubes connected between the ink tank 19T and the carriage 21, and enables an ink to flow between the connected tubes. In an example shown in FIG. 3, the joint 40J connects two tubes 40A and 40B on a support plate 41 of the ink supply tubes 40. Each tube 40A and 40B connected to the both sides of the joint 40J is fixed using a second fixing tool 62 and a third fixing tool 63 (for example, adhesive tape), so that the tubes 40A and 40B are unlikely to deviate from the joint 40J.

Figure 4:
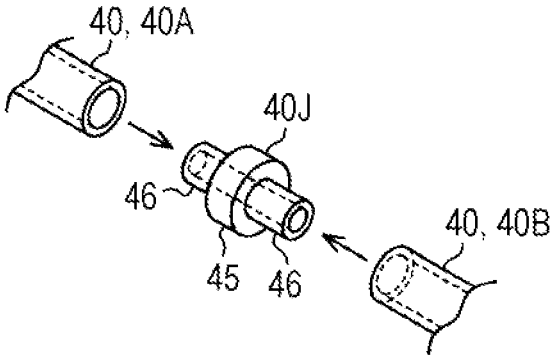
FIG. 4 is a perspective view illustrating an example of a joint.

The joint 40J used in the embodiment, as illustrated in FIG. 4, has a joint main body 45 in a cylindrical shape and a pair of tube portions 46 projecting from the both end surfaces of the joint main body 45 in an axis direction. The pair of tube portions 46 communicates with each other in the axis direction. In addition, the joint 40J, as illustrated in FIG. 5, has a joint main body 45 in a rectangular plate shape and four pairs of tube portions 46 with every four tube portions projecting from the both end surfaces of the joint main body 45 in the axis direction. In the four pairs of tube portions 46, two tube portions forming a pair communicate with each other in the axis direction.

A joint portion of the tubes 40A and 40B connected through the joint 40J are positioned at portions in addition to the deformable moving unit 40H of the ink supply tubes 40 as illustrated in FIG. 3. Therefore, a location connected using the joint 40J of the ink supply tubes 40 is not a curved portion 40C, so that the tube is unlikely to deviate from the joint 40J.

Figure 6:
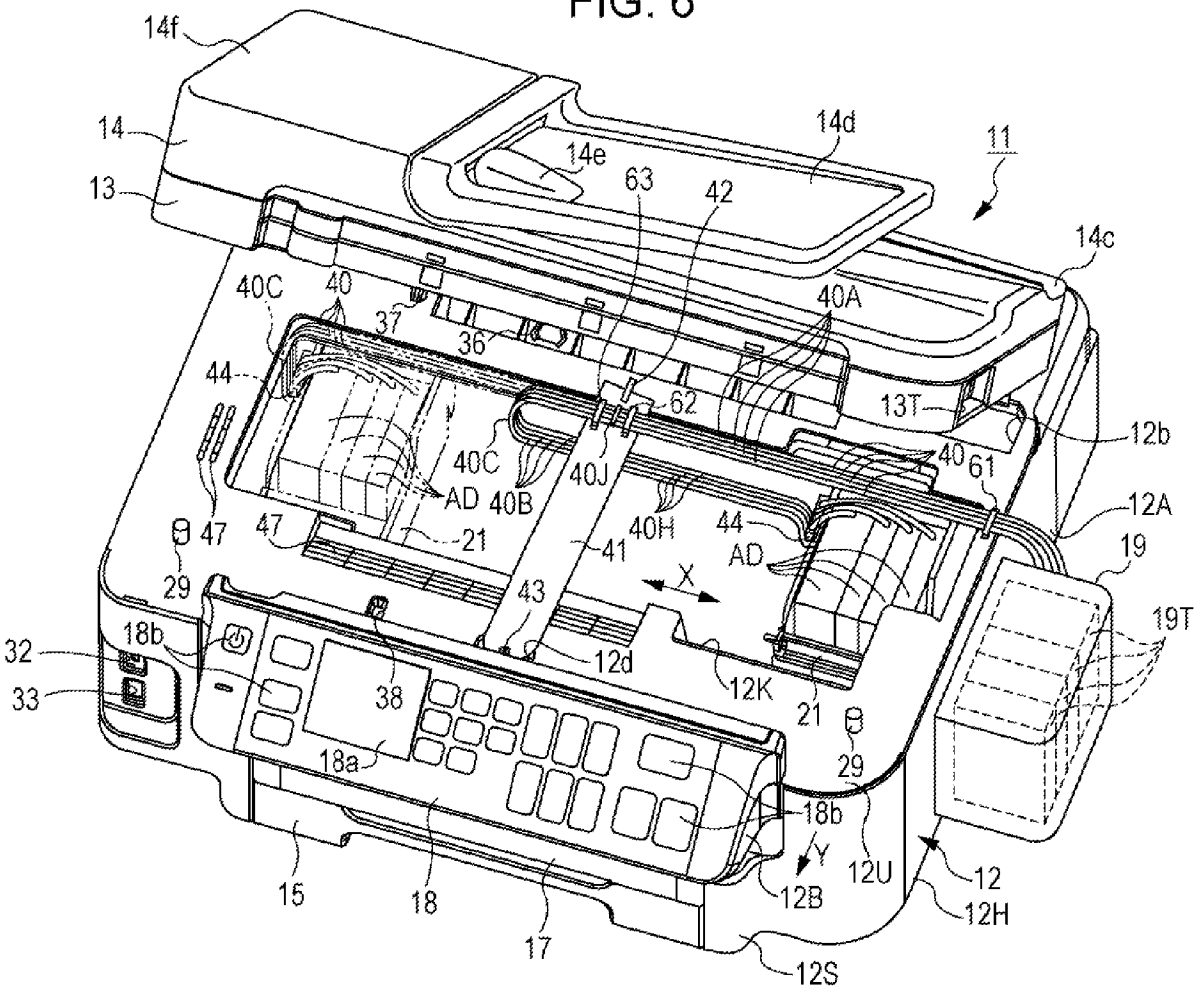
FIG. 6 is a perspective view illustrating the printer including a pull-around structure of other ink supply tubes according to a first embodiment.

Next, as illustrated in FIG. 6, in the embodiment, the ink supply tubes 40 may be pulled around so that a portion where the curved portion 40C of the deformable moving unit 40H is formed may be opposite to FIG. 3 with respect to the carriage 21. In FIG. 6, some configuration members such as transportation mechanism of sheet P seen from the opening portion 12K and a moving mechanism of the carriage 21 are omitted.

In an example of FIG. 6, the tank unit 19 is disposed on the outside of the movement region of the carriage 21, in particular, on the outside of a home position side of the housing 12H. The ink supply tubes 40 first extend from the tank unit 19, and extend from the right side surface of the apparatus main body 12 in FIG. 6 and slightly back side in the main scanning direction X to be fixed to a portion disposed on the upper surface portion 12U by the first fixing tool 61 (for example, adhesive tape). Then, the middle portion of the downstream side which is a connection side with the adapter AD in the ink supply tubes 40 is sequentially fixed to the upper surface of the support plate 41 by the second fixing tool 62 and the third fixing tool 63 (respectively, for example, adhesive tape). The ink supply tubes 40 have a portion fixed to a further upstream side by a predetermined distance than the curved portion 40C by the third fixing tool 63, and the third fixing tool 63 functions as an example of the fixing portion.

A close portion to the adapter AD in the ink supply tubes 40 is bundled by a holding member 44 fixed to the left side surface of the carriage in FIG. 6, and an end portion further downstream side than a position bundled by the holding member 44 is connected to a supply tube (not illustrated) on the upper surface of the adapter AD, respectively. In the embodiment, in the ink supply tubes 40, a portion between a boundary portion with the non-moving portion and the holding member 44 is the deformable moving unit 40H. In addition, in FIG. 6, the joint 40J of the ink supply tubes 40 is provided when needed. In an example of FIG. 6, as illustrated in FIG. 3, both side portions interposing the joint 40J connecting the tubes 40A and 40B are fixed to the upper surface of the support plate 41 using the second fixing tool 62 and the third fixing tool 63. As illustrated in FIG. 6, the support plate 41 is adjusted to an angle rotated slightly in a clockwise direction with respect to the angle of the support plate 41 in FIG. 3.

Next, an operation of the printer 11 of the first embodiment will be described.

In the printer 11, by fixing the ink supply tubes 40 so as not to relatively move with respect to the opening portion 12K using the first to third fixing tools 61, 62, and 63 (for example, adhesive tape), it is possible to easily form the fixing portion. In addition, by adjusting the angle of the support plate 41 and adjusting a fixed position of the third fixing tool 63, it is possible to fix a portion of the upstream side with a predetermined distance from the deformable moving unit 40H performing a follow-up deformation along the movement of the carriage 21.

Furthermore, in a case where the ink supply tubes 40 are removed from the apparatus main body 12 so as to perform maintenance of the ink supply tubes 40, it is possible to easily remove the ink supply tubes 40 from the apparatus main body 12 by peeling off the first to the third fixing tools 61, 62, and 63 (for example, adhesive tape).

According to the first embodiment, it is possible to obtain the effects illustrated below.

(1) Since a portion of the ink supply tubes 40 (the middle portion) may be fixed so as not to relatively move with respect to the opening portion 12K of the apparatus main body 12 (printing function unit 12A), it is possible to stably form the deformable moving unit 40H performing a follow-up deformation along the movement of the carriage 21 between the opening portion 12K and the liquid ejecting head 22. As a result, the ink supply tubes 40 can be inhibited from disturbing the movement of the carriage 21.

(2) The deformable moving unit 40H of the ink supply tubes 40 has substantially the same tube length at both sides in a movement range of the carriage 21, so that it is possible to suppress the length of the ink supply tubes 40 present on the liquid ejecting head 22 side from the fixing portion to be relatively short.

(3) The third fixing tool 63 which is an example of the fixing portion is provided on a side rotatably supporting the image reading unit 13 with respect to the opening portion 12K, so that when the image reading unit 13 opens the opening portion 12K of the housing 12H, a view in the opening portion 12K is unlikely to be disturbed by the liquid supply tube. Therefore, it is relatively easy to check a shape in the apparatus main body 12 through the opening portion 12K. For example, the shape of jam of the sheet P during a jam error of the sheet is easily checked and the processing of resolving the sheet jam may be performed in a relatively smooth way.

(4) By displacing the support plate 41 in a direction far away from a substantially central position in the main scanning direction X of the opening portion 12K of the apparatus main body 12, a user can easily insert the finger to the movement region of the carriage 21 through the opening portion 12K of the apparatus main body 12 (printing function unit 12A). Therefore, even if the carriage 21 is in the middle position of the movement region, it is possible to easily perform, for example, maintenance of the carriage 21 or the processing of the sheet jam.

(5) Since the support plate 41 is provided to be rotatable with respect to the upper surface portion 12U of the apparatus main body 12, it is possible to relatively easily realize a configuration where the support plate 41 may be displaced in a direction far from the substantially central position in the main scanning direction X of the opening portion 12K of the apparatus main body 12.

(6) By using screw holes formed for a screw fixing the locking member in the locking concave portion 12*d* provided on the upper surface portion 12U in order to lock the image reading unit 13 in a close state with respect to the apparatus main body 12, the screw 43 screwed into the screw hole is set to a rotation axis of the support plate 41. Therefore, the support plate 41 can be rotatably supported at a substantially central position in the main scanning direction X of the opening portion 12K, and even if a longitudinal direction of the support plate 41 is not largely inclined to the sub-scanning direction Y, it is possible to support an appropriate fixed location of the ink supply tubes 40. Thus, it is possible to finish the support plate 41 in a relatively short length, for example, during maintenance or sheet jam processing, the support plate 41 avoided by rotation is not a significant obstacle. In addition, since existing screw holes are used, it is not necessary to perform an extra processing such as a screw hole processing in the housing 12H.

(7) By connecting a plurality of tubes through the joint 40J, it is possible to adjust the ink supply tubes 40 to be an appropriate length to pull around. In addition, since a plurality of tubes with a length relatively easy to handle needs to be pulled around, an operation of pulling around the ink supply tubes 40 is relatively simple.

(8) The joint portion of the tubes 40A and 40B connected through the joint 40J are positioned at a portion in addition to the deformable moving unit 40H of the ink supply tubes 40. Therefore, a location connected using the joint 40J of the ink supply tubes 40 is not the curved portion 40C, so that a tube is unlikely to deviate from the joint 40J.

(9) Since a plurality of ink tanks 19T are provided, and a plurality of ink supply tubes 40 are pulled around according to the number of the ink tanks 19T, it is possible to supply a plurality of colors of ink through the plurality of ink supply tubes 40 to the liquid ejecting head 22 through each adapter AD to correspond to a color printing.

(10) The ink tank 19T is positioned at the outside of the apparatus main body 12 (printing function unit 12A), a restriction on an ink containing amount is eased. Therefore, it is possible to include the ink tank 19T which can contain a large amount of ink.

(11) In the containing unit 12S formed by the housing portion formed to project to the front surface portion of the housing 12H, the sheet feeding cassette 15 is contained so as to align the front surface with the containing unit 12S, at a ratio of configuration of enabling the sheet to be supplied from the front surface side of the apparatus main body 12, it is possible to relatively inhibit the printer 11 from being larger (in particular, increase in a printer low surface area). In addition, a base portion 12B of the operation panel unit 18 is configured by the housing portion indicating an inclined surface whose lower side further projects to a discharge direction (that is, the sub-scanning direction Y) side of the sheet P than the upper side. Then, on the inclined surface of the base portion 12B, a display unit 18*a* (for example, liquid crystal display) and an operation button 18*b* are attached. Therefore, visibility of the display unit 18*a* is improved, and operability of the operation button 18*b* is also well ensured.

Second Embodiment

Next, a configuration of a second embodiment according to the fixing portion fixing the ink supply tubes 40 will be described referring to FIGS. 7 and 8. In description of FIGS. 7 and 8, the same reference numbers are given to configuration members the same as in FIGS. 1 to 3, and the description thereof will be omitted. In addition, the joint 40J of the ink supply tubes 40 will not be illustrated in FIGS. 7 and 8.

Figure 7:
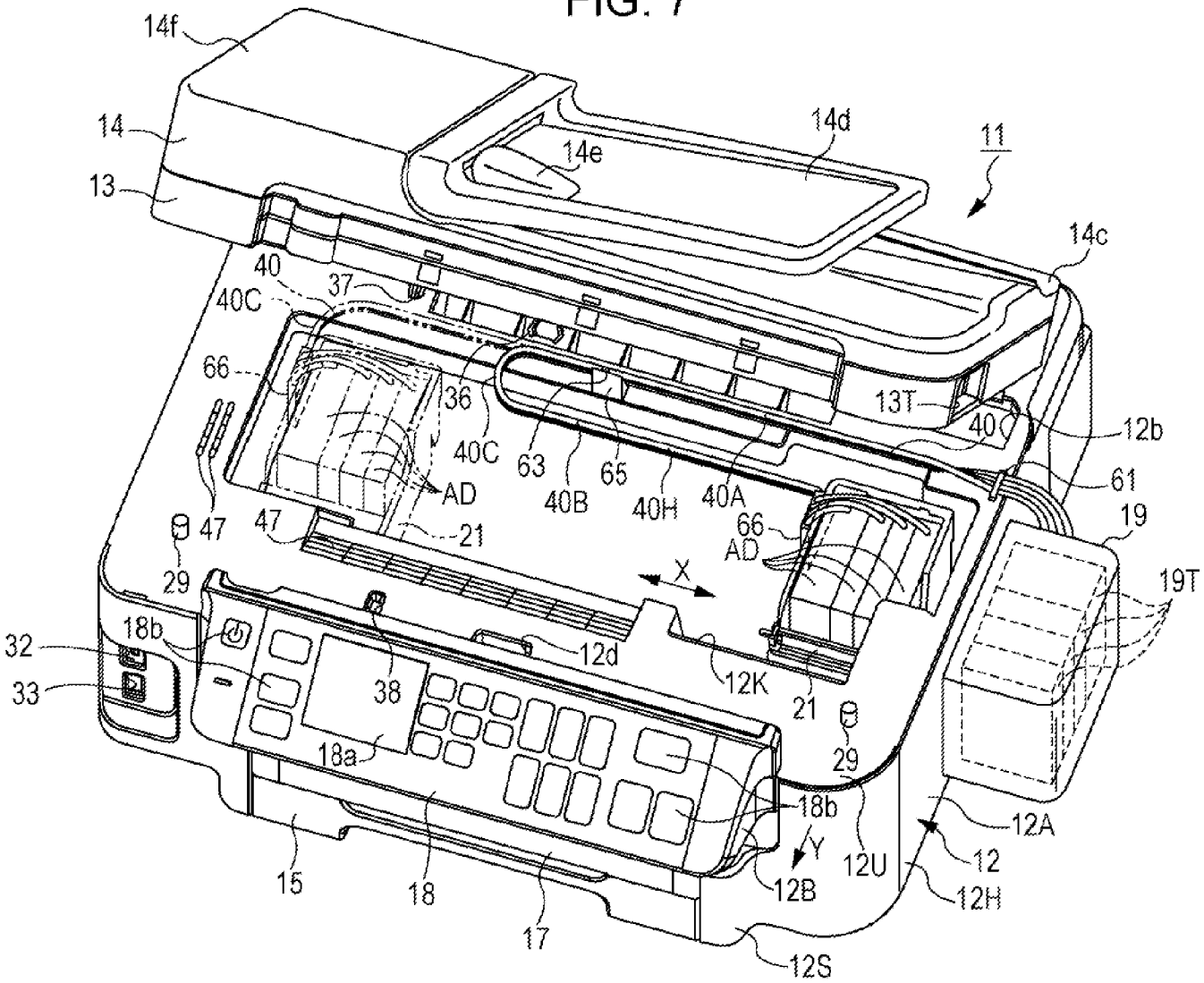
FIG. 7 is a perspective view illustrating the printer including a pull-around structure of ink supply tubes according to a second embodiment.

An example of the fixing portion of a second embodiment, as illustrated in FIG. 7, is an inclined block 65 fixed to a portion of the peripheral portion of the opening portion 12K in the upper surface portion 12U of the housing 12H. The inclined block 65 holds a surface (tube surface) through each central axis of each of a plurality of ink supply tubes 40 in a state of being inclined at a predetermined angle with respect to the opening surface of the opening portion 12K. The holding member 66 where a portion of the adapter AD side of the ink supply tubes 40 is fixed to a side surface of the carriage 21 in a state where a portion of the adapter AD side of the ink supply tubes 40 is bundled holds a portion extending along the main scanning direction X from the holding member 66 to the upstream side to be inclined in the same direction as inclined by the inclined block 65.

A detailed configuration will be described using FIG. 8. FIG. 8 illustrates a schematic cross-section cut at the location of the holding member 66 fixed to the side surface of the carriage 21 in the main scanning direction X in FIG. 7 and viewing the curved portion 40C side. As illustrated in FIG. 8, the inclined block 65 has a triangular shape, and is fixed to the upper surface portion 12U in a direction where the inclined surface 65*a* thereof extends in the main scanning direction X. In the inclined surface 65*a*, a plurality of ink supply tubes 40 (four in the example) are fixed by the third fixing tool 63 (for example, adhesive tape) in a state of being arranged in a row.

Figure 8:
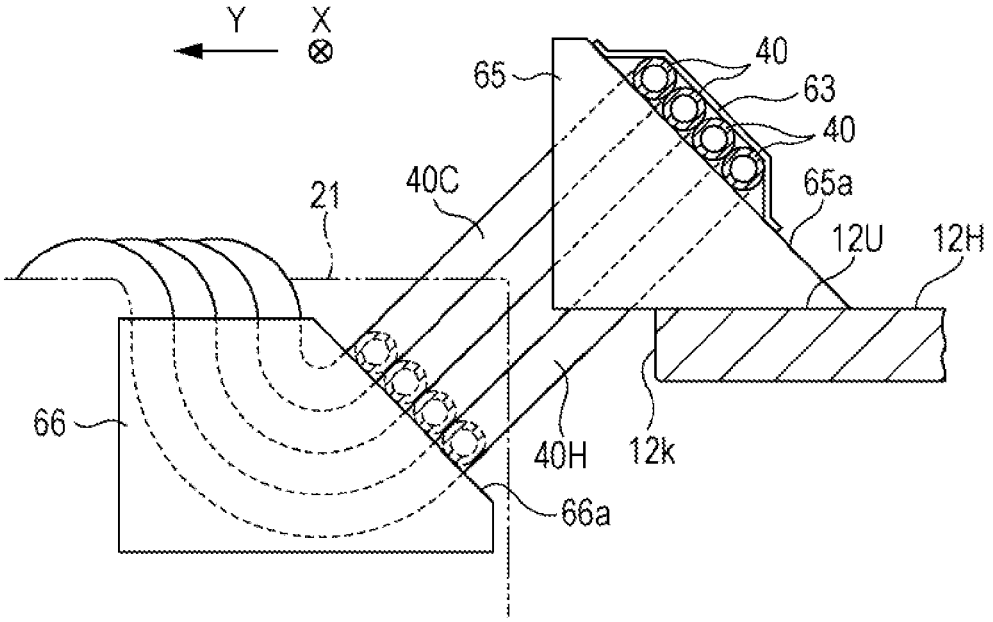
FIG. 8 is a schematic side cross-sectional view illustrating the pull-around structure of the ink supply tubes.

On the other hand, as illustrated in FIG. 8, a holding member 66 fixed to the side surface of the carriage 21 is formed on the inclined surface 66*a* which is a surface of a side opposite to the inclined block 65 and in parallel with the inclined surface 65*a*. Therefore, a plurality of tubes extending from the adapter AD and bundled using the holding member 66 are held in a state of being arranged in a row so as to form a tube surface substantially in parallel with the tube surface of the inclined block 65 side along the inclined surface 66*a*. Then, the deformable moving unit 40H is formed in a state where both sides of the tube surfaces are obliquely inclined across the curved portion 40C.

Therefore, even in a configuration in which a space for pulling around the ink supply tubes 40 in the opening portion 12K of the housing 12H, it is possible to form the deformable moving unit 40H so as to form the tube surface which is obliquely opposite to the opening surface of the opening portion 12K in a substantially parallel way.

According to the above-mentioned second embodiment, it is possible to obtain the following effects in addition to effects (1) to (11) in the above-mentioned first embodiment.

(12) Even in a configuration where a space for pulling around the ink supply tubes 40 can not be ensured in the opening portion 12K of the housing 12H, it is possible to form the deformable moving unit 40H so as to form a tube surface which is obliquely opposite to the opening surface of the opening portion 12K in a substantially parallel way.

Third Embodiment

Next, a configuration of a third embodiment according to the fixing portion fixing the ink supply tubes 40 will be described referring to FIGS. 9 and 10. In description of FIGS. 9 and 10, the same reference numerals are given to the configuration members the same as in FIGS. 1 to 3, the description for these is omitted. In addition, the joint 40J of the ink supply tubes 40 will not be illustrated in FIGS. 9 and 10.

An example of the fixing portion in the third embodiment, as illustrated in FIG. 7, is the third fixing tool 63 (for example, adhesive tape) fixing a portion of the ink supply tubes 40 to the peripheral portion of the opening portion 12K in the upper surface portion 12U of the housing 12H.

Figure 10:
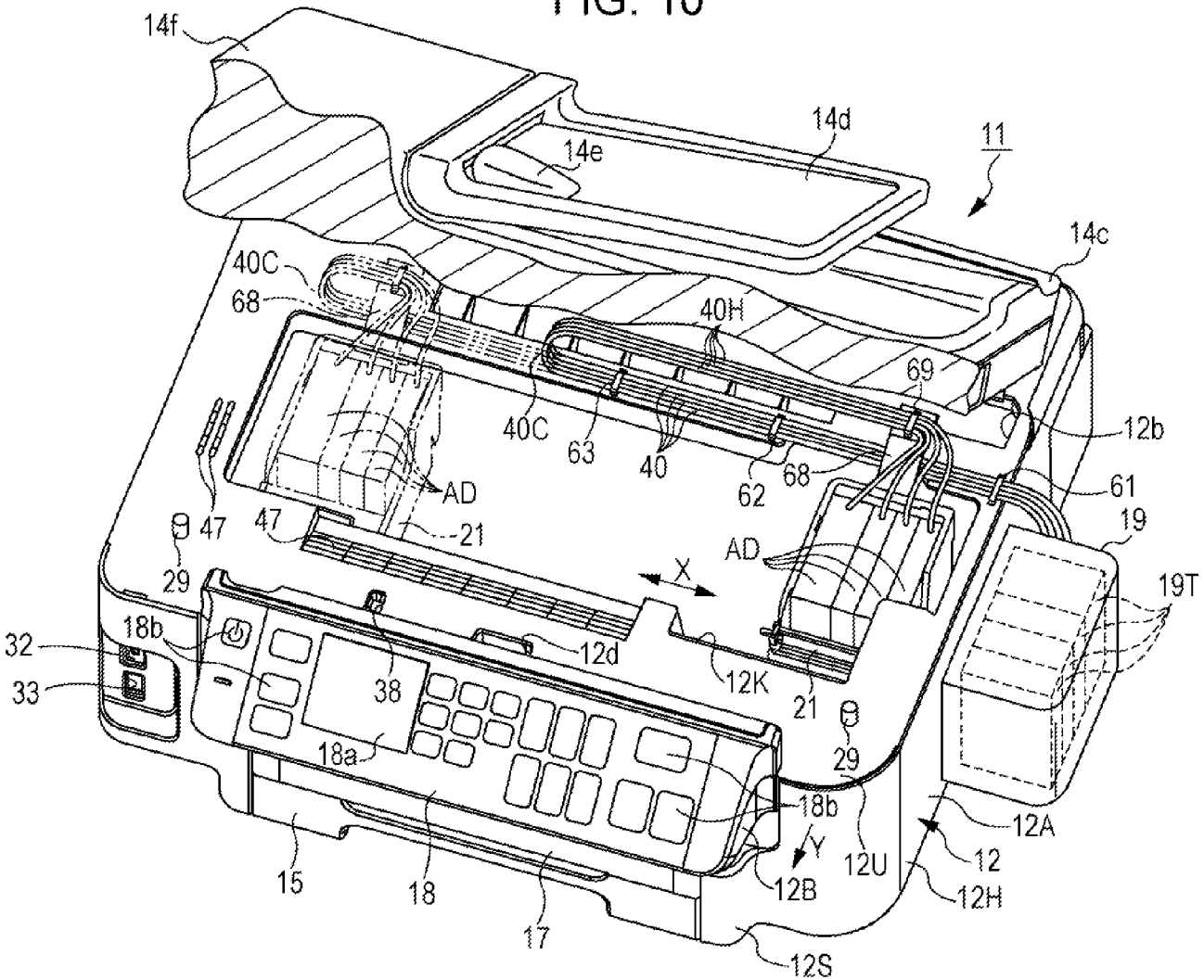
FIG. 10 is a perspective view illustrating the printer including the pull-around structure of the ink supply tubes.

More specifically, the ink supply tubes 40 first extend from the tank unit 19, and extend from the right side surface and slightly back side in FIG. 10 of the apparatus main body 12 in the main scanning direction X to be fixed to a portion disposed on the upper surface portion 12U by the first fixing tool 61. Then, the middle portion of the downstream side which is a connection side to the adapter AD in the ink supply tubes 40 is sequentially fixed to a portion disposed on the upper surface portion 12U by the second fixing tool 62 and the third fixing tool 63.

In addition, as illustrated in FIG. 10, the close portion to the adapter AD in the ink supply tubes 40 is fixed to the upper surface of the front end portion of the support member 68 obliquely extending from the back surface portion of the carriage 21 to the rearward upside (backward upside) in a state of being bundled by the adhesive tape 69. Then, each end portion of the downstream side is connected to the supply tube (not illustrated) on the upper surface of the adapter AD rather than a location fixed by the adhesive tape 69 to the support member 68 in the ink supply tubes 40.

A portion of the ink supply tubes 40 is fixed further to a position on the upstream side than the boundary portion with a non-moving portion by a predetermined distance by the third fixing tool 63, and accordingly the deformable moving unit 40H is formed further downstream side than the fixed position thereof.

A detailed structure will be described using FIG. 9. FIG. 9 illustrates a schematic cross-section cut at the location of the support member 68 fixed to the back surface portion of the carriage 21 in the main scanning direction X in FIG. 10 and viewing the curved portion 40C side. More specifically, as illustrated in FIG. 9, the support member 68 where a base portion is fixed to a back surface portion of the carriage 21 has the support portion 68*a* which obliquely extends to upward rear side and then extends to rearward in a substantially parallel way. The support portion 68*a* is positioned at a height spaced away from the upper surface of the peripheral portion of the opening portion 12K by a predetermined space distance. On the upper surface of the support portion 68*a*, a portion of the plurality of ink supply tubes 40 is fixed using the adhesive tape 69.

Therefore, a plurality of tube portions (tube surfaces) disposed on the upper surface of the rear side peripheral portion along the opening portion 12K in the upper surface portion 12U of the housing 12H, and a plurality of tube portions (tube surface) supported on the upper surface of the support portion 68*a* which is the front end portion of the support member 68 are positioned to be opposite to each other in a vertical direction. Therefore, in a course of moving a space between a position (a home position in the example) of the carriage 21 illustrated by a solid line in FIG. 10 and a position (an end position of reverse home position side in the example) of the carriage 21 illustrated by a double dashed line in the same figure, the deformable moving unit 40H deforms the curved portion 40C to be displaced in the main scanning direction X.

According to the structure, even in a configuration in which a space for pulling around the ink supply tubes 40 is hardly ensured in the opening portion 12K of the housing 12H, the ink supply tubes 40 may be disposed on the upper side of the housing 12H, so that it is possible to supply an ink to each adapter AD on the carriage 21 from an external tank unit 19 while inhibiting the ink supply tubes 40 from being broken.

Fourth Embodiment

Figure 11:
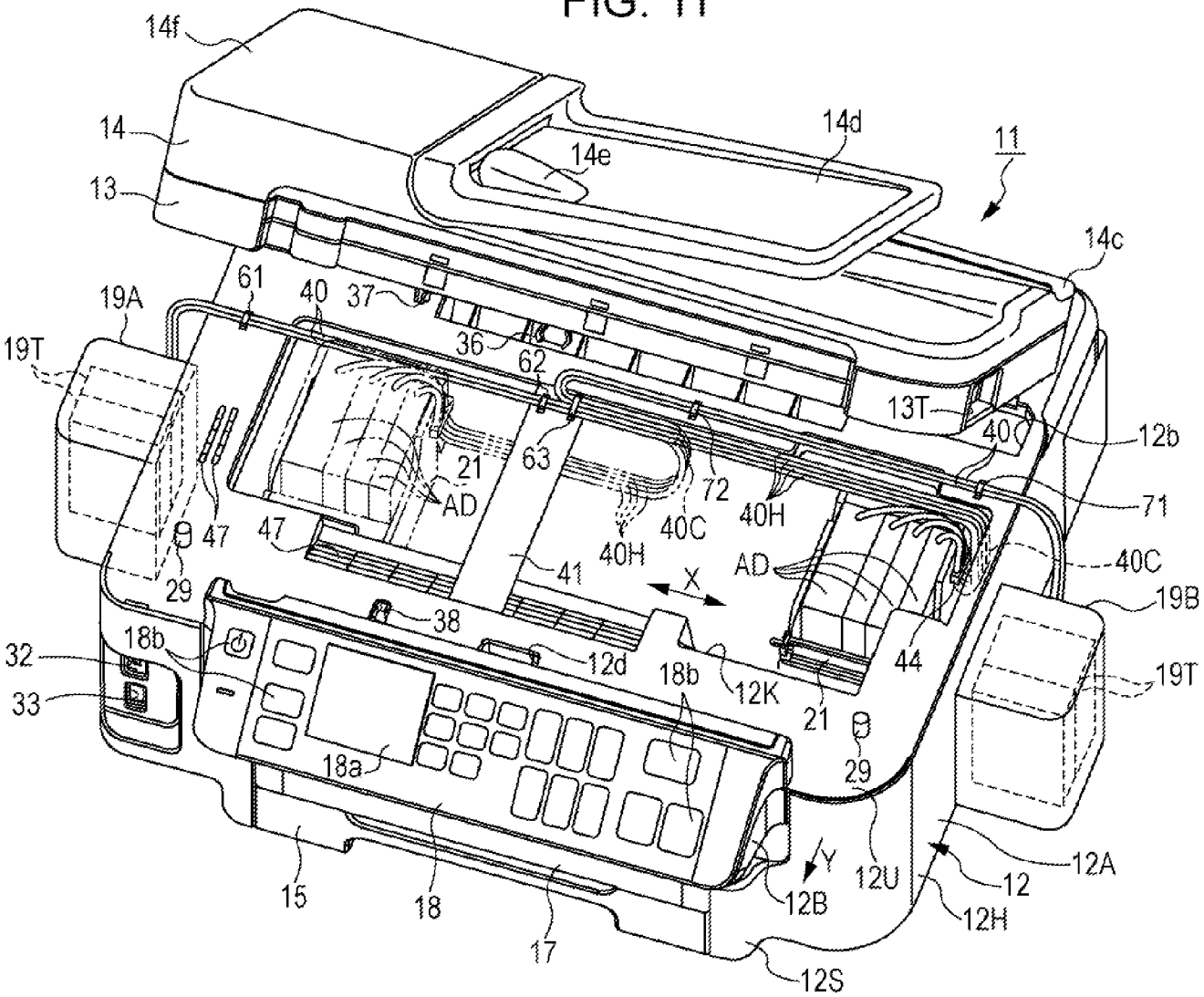
FIG. 11 is a perspective view illustrating the printer including the pull-around structure of the ink supply tubes according to a fourth embodiment.

Next, a configuration of fourth embodiment according to the fixing portion fixing the ink supply tubes 40 will be described referring to FIG. 11. In description of FIG. 11, the same reference numerals are given to the configuration members the same as in FIGS. 1 to 3, the description for these is omitted. In addition, the joint 40J of the ink supply tubes 40 will not be illustrated in FIG. 11.

An example of the fixing portion in the fourth embodiment is basically the same as in FIG. 3. In the embodiment, as illustrated in FIG. 11, a plurality ((N+M), for example, four) of ink supply tubes 40 extending from each of a plurality of adapters AD is divided into N (for example, two) and the remaining M (for example, two) (here, N and M are natural numbers). Then, one end portion of N ink supply tubes 40 is connected to each ink tank 19T in the tank unit 19A disposed outside of the left side (reverse home position side) of the housing 12H, thereby connecting an end portion of the M ink supply tubes 40 to each ink tank 19T in a tank unit 19B disposed outside of the right side (home position side) of the housing 12H.

N ink supply tubes among the plurality of ink supply tubes 40 are fixed using the first fixing tool 61 (for example, adhesive tape) to the left end portion of the upper surface portion 12U of the housing 12H, and furthermore a portion of the downstream side is fixed to the upper surface of the support plate 41 using the second fixing tool 62 and the third fixing tool 63. On the other hand, the remaining M ink supply tubes 40 are fixed using the fixing tools 71 and 72 (for example, adhesive tape) to the peripheral portion of the rear side along the opening portion 12K in the upper surface portion 12U of the housing 12H, a direction of pulling around the tube is inverted at a portion of the downstream side, and the inverted rear portion is fixed to the upper surface of the support plate 41 by the third fixing tool 63. Then, after four ink supply tubes 40 fixed to the upper surface of the support plate 41 by the third fixing tool 63 are bundled by the holding member 44 where a portion on the downstream side extends in the same direction (rightward in FIG. 11) and is fixed to the right side surface of the carriage 21, each of the other end portions is connected to the supply tube (not illustrated) projecting from the upper surface of each adapter AD. In the embodiment, the both end portions of the support plate 41 in the longitudinal direction are fixed using an adhesive tape which is not illustrated, and a fixing method of using either adhesive or a screw. Of course, in a similar way as in the first embodiment, by rotatably supporting one end portion of the support plate 41 centered on a screw 43, a configuration of fixing the other end portion using a known fixing tool such as adhesive tape and the like may be provided. Even if the plurality of ink supply tubes 40 are divided and pulled around in a horizontal direction, it is possible to obtain substantially the same effects as in the first embodiment.

Fifth Embodiment

Next, a configuration of the printer 11A as a liquid ejecting apparatus which does not have an image reading function will be described referring to FIGS. 12 to 14. The printer 11 in the first to the fourth embodiments used to be a so-called multi-function unit, but the printer 11A in the following embodiments includes a printing function unit (printer unit), but does not have an image reading unit (scanner unit). In description of FIGS. 12 to 14, the same reference numerals are given to the configuration members the same as in FIGS. 1 to 3, the description for these is omitted. A configuration of the fixing portion fixing the ink supply tubes 40 corresponds to the first embodiment applied to the printer 11A of a single function only having a printing function.

Figure 12:
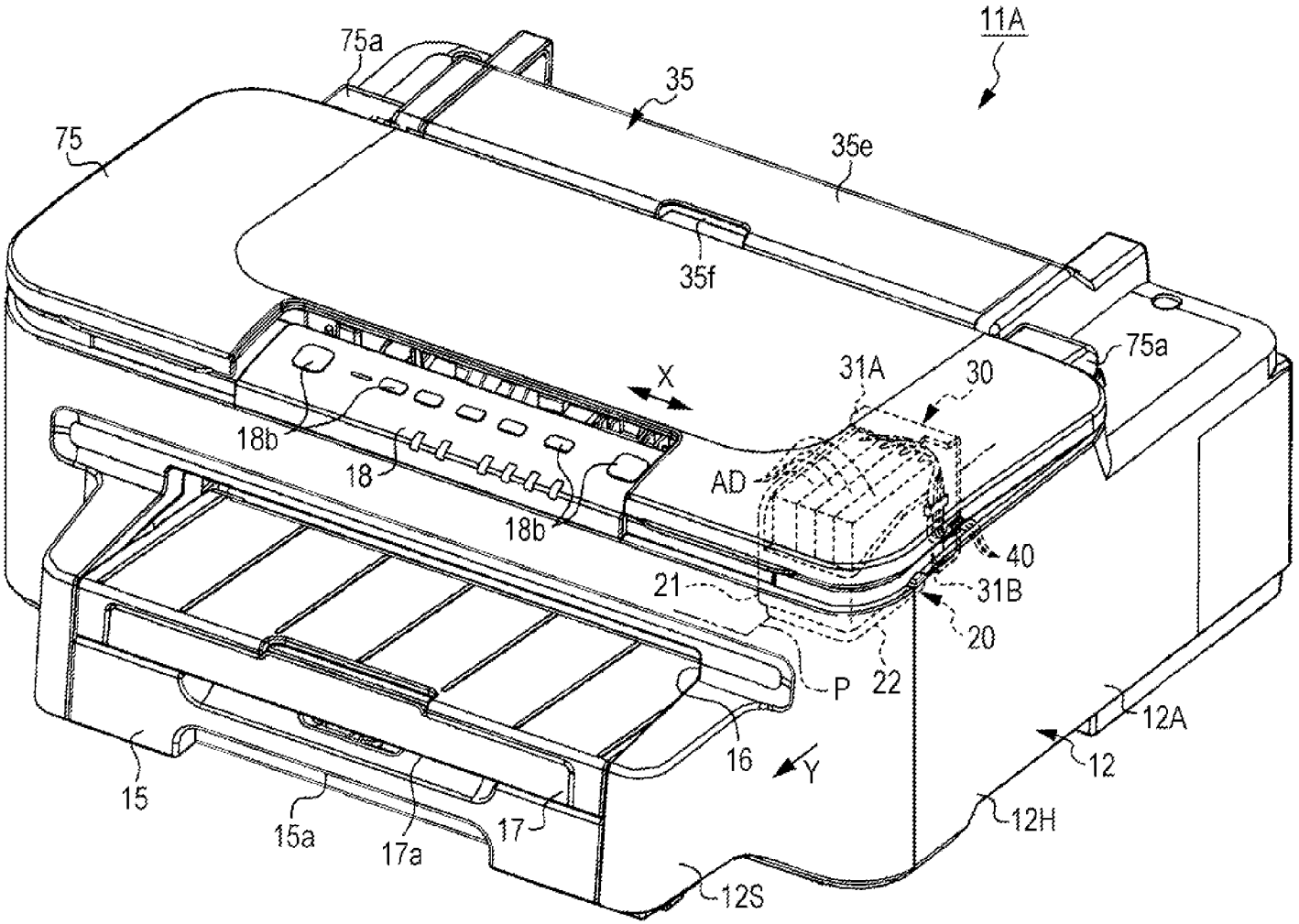
FIG. 12 is a perspective view illustrating the printer according to a fifth embodiment.

As illustrated in FIG. 12, the printer 11A of the embodiment includes a printing function unit 12A formed of an apparatus main body 12 having a printing function. The printer 11A receives a supply of an ink from the ink tank 19T (refer to FIG. 14) as an example of a liquid containing unit having a substantially rectangular shape as a separate body from the apparatus main body 12 thereof. Then, in the printer 11A, an ink contained in the ink tank 19T is supplied from the ink tank 19T side positioned at the outside of the apparatus main body 12 to the apparatus main body 12 side through the ink supply tubes 40 (see FIG. 14).

The apparatus main body 12 of the printer 11A has the housing 12H embedded with the printing unit 20. A lid portion 75 as an example of a cover member rotates (displace) about a hinge 75*a* provided on one side end (rearward side) of the apparatus main body 12, and the hinge 75*a* has a configuration in which the front end portion side (front end side in FIG. 14) of the opposite side is lifted. For example, it is possible for a user of the printer 11A to lift the lid portion 75 during maintenance. By the lifting, an opening portion 12K (refer to FIG. 14) exposing at least a portion of the movement region of the carriage 21 provided upward of the printing unit 20 and disposed to reciprocate in the printing function unit 12A is exposed.

Furthermore, in the rear side of the lid portion 75 in the apparatus main body 12, a manual sheet feeding mechanism 35 is provided. The manual sheet feeding mechanism 35 is an on-off type in which a cover 35*e* including the sheet feeding tray 35*a* (refer to FIG. 13) may rotate around the rear end portion, and the cover 35*e* is held in a close state as illustrated in FIG. 12 when not used. In the front end portion of the cover 35*e* in a close state, a grip portion 35*f* in a concave shape is formed, and a user grasps the grip portion 35*f* to rotate the cover 35*e* rearward, and accordingly the sheet feeding tray 35*a* is in an open state in use where the sheet feeding tray 35*a* obliquely rises (refer to FIG. 13). A configuration of the manual sheet feeding mechanism 35 in an open state will be described below.

In addition, at the lower portion of the apparatus main body 12, the sheet feeding cassette 15 which may overlap and contain a plurality of sheets P is detachably provided. The sheet P contained in the sheet feeding cassette 15 is fed from the rear to the front to the printing unit 20 provided in the printing function unit 12A one by one, and a printing is performed by the printing unit 20 with respect to the fed sheet P. A configuration of the printing unit 20 is basically the same as one of the printer 11 in the first embodiment. Then, the printed sheet P where a printing is finished by the printing unit 20 is discharged from the sheet discharge port 16 provided at the front surface of the apparatus main body 12 (printing function unit 12A).

In the apparatus main body 12 (printing function unit 12A), the upstream of the sheet feeding cassette 15 or the downstream of the sheet discharge port 16, the stacker 17 as an example of a discharge tray is accommodated. The stacker 17 is used by pulling a length corresponding to the size of the sheet P from the apparatus main body 12 in a discharge direction (transportation direction) of the sheet P.

The containing unit 12S having a containing concave unit containing the sheet feeding cassette 15 and the stacker 17 at a central portion in the width direction is configured using a housing portion formed to project to the discharge direction (here, a sub-scanning direction Y) of the sheet P. Allowing the containing unit 12S to project is because a required length of the sheet feeding cassette 15 in the sub-scanning direction Y is longer than the required length of the housing 12H in the sub-scanning direction in the printing unit 20. Therefore, the sheet feeding cassette 15 and the stacker 17 is contained so as to align the front end surface with the containing unit 12S in a state of projecting from the apparatus main body 12 to the sub-scanning direction Y (frontward). Specifically, When determining the length of the apparatus main body 12 in the sub-scanning direction Y according to the length of the sheet feeding cassette 15 in the sub-scanning direction Y which is needed to contain the sheet P of a predetermined size (as an example, A4), the apparatus main body 12 gets larger (an increase in the lower area). In order to avoid this even a little, the containing unit part of the sheet feeding cassette 15 only is allowed to project. In other words, by making a shape of gouging out the outside of the containing unit 12S in the width direction, it is possible to inhibit the lower surface area of the printer 11A from increasing. In addition, the front surface position when accommodating the stacker 17 is determined according to the projected front surface position of the sheet feeding cassette 15, so that a projecting length of the stacker 17 when pulled out is ensured to be relatively long. Further, by the projection, the stacker 17 may easily be pulled out from the apparatus main body 12 by a grip portion 17*a*. The sheet feeding cassette 15 is detachably provided at the front surface of the apparatus main body 12, and relatively inhibiting the printer 11A (in particular, increase in the printer lower surface area) from being larger by the configuration in which the feeding from the front surface side of the apparatus main body 12 is possible.

On the other hand, as illustrated in FIG. 12, on the upper portion of the apparatus main body 12 (printing function unit 12A), an operation panel unit 18 for performing various types of operation such as performing a printing operation using the printing unit 20 and the like is disposed. The operation panel unit 18 is configured by a housing portion having an inclined surface whose lower side further projects to the discharge direction (that is, the sub-scanning direction Y) of the sheet P than the upper side. Then, an operation button 18*b* is provided on the inclined surface of the operation panel unit 18. In the operation button 18*b*, there are, for example, a power button and a printing start button and the like. The operation surface of the operation panel unit 18 is an inclined surface with the front falling, thereby satisfactorily securing the operability of the operation button 18*b* for the user.

Figure 13:
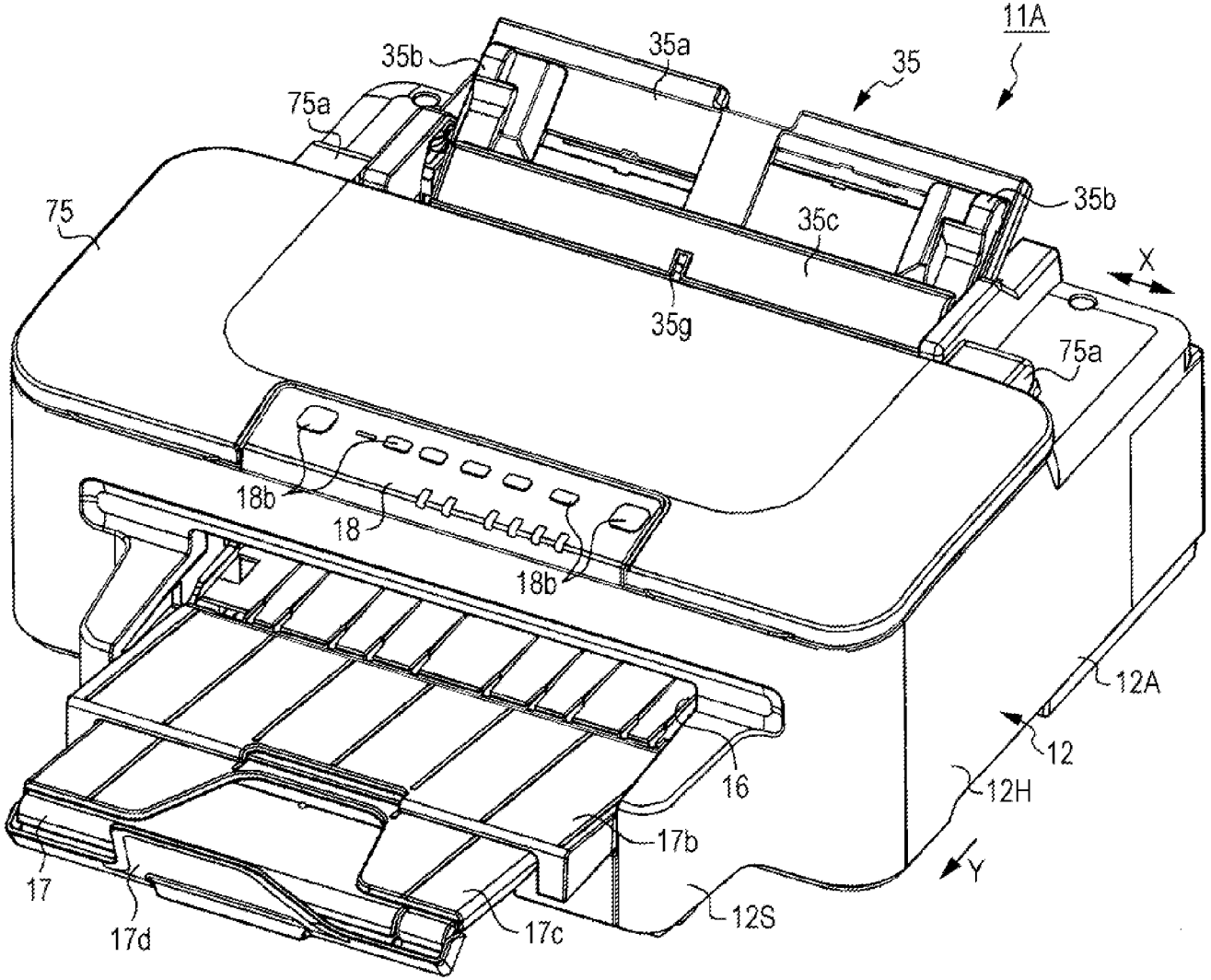
FIG. 13 is a perspective view illustrating the printer in a state of opening a stacker and a manual sheet feeding mechanism.

In addition, as illustrated in FIG. 13, on the back surface side of the apparatus main body 12 (printing function unit 12A), the manual sheet feeding mechanism 35 is mounted. The manual sheet feeding mechanism 35 is a mechanism for a user's manual setting and feeding one sheet P. The manual sheet feeding mechanism 35 includes the sheet feeding tray 35*a* in a substantially rectangular plate shape, a pair of sheet guide 35*b* for an operation of determining a position in the width direction on the sheet feeding tray 35*a*, and a protective plate 35*c* provided for a purpose of preventing debris and the like from falling to the feeding port (not illustrated) in an open state of the manual sheet feeding mechanism 35. The sheet feeding tray 35*a* is provided to be rotatably operated in a predetermined angle range around the base end portion (a lower end portion in FIG. 13), and disposed in an open state illustrated in FIG. 13 in which the sheet P is inclined to be set, or in a close state where the sheet is rotated from the open state to the front side of FIG. 13 to be accommodated in the apparatus main body 12. The protective plate 35*c* is biased in a direction approaching the sheet feeding tray 35*a* side by elasticity of the torsion coil spring 35*g*, and when opening the sheet feeding tray 35*a*, is disposed at a protective position illustrated in FIG. 13 which prevent the debris fallen to the opened location from entering the feeding port.

In addition, as illustrated in FIG. 13, the stacker 17 is three-stage way as an example, and includes a first tray 17*b*, a second tray 17*c* and a third tray 17*d*. The first tray 17*b* is slidably connected to the apparatus main body 12, and the second tray 17*c* is slidably connected to the first tray 17*b*. Then, the third tray 17*d* is rotatably connected to the front end portion of the second tray 17*c*, and is disposed in a close position of being accommodated in a state overlapping with respect to the second tray 17*c*, and an open position functioning as a stopper of the sheet lifted in a rising pose at a predetermined angle as illustrated in FIG. 2.

Figure 14:
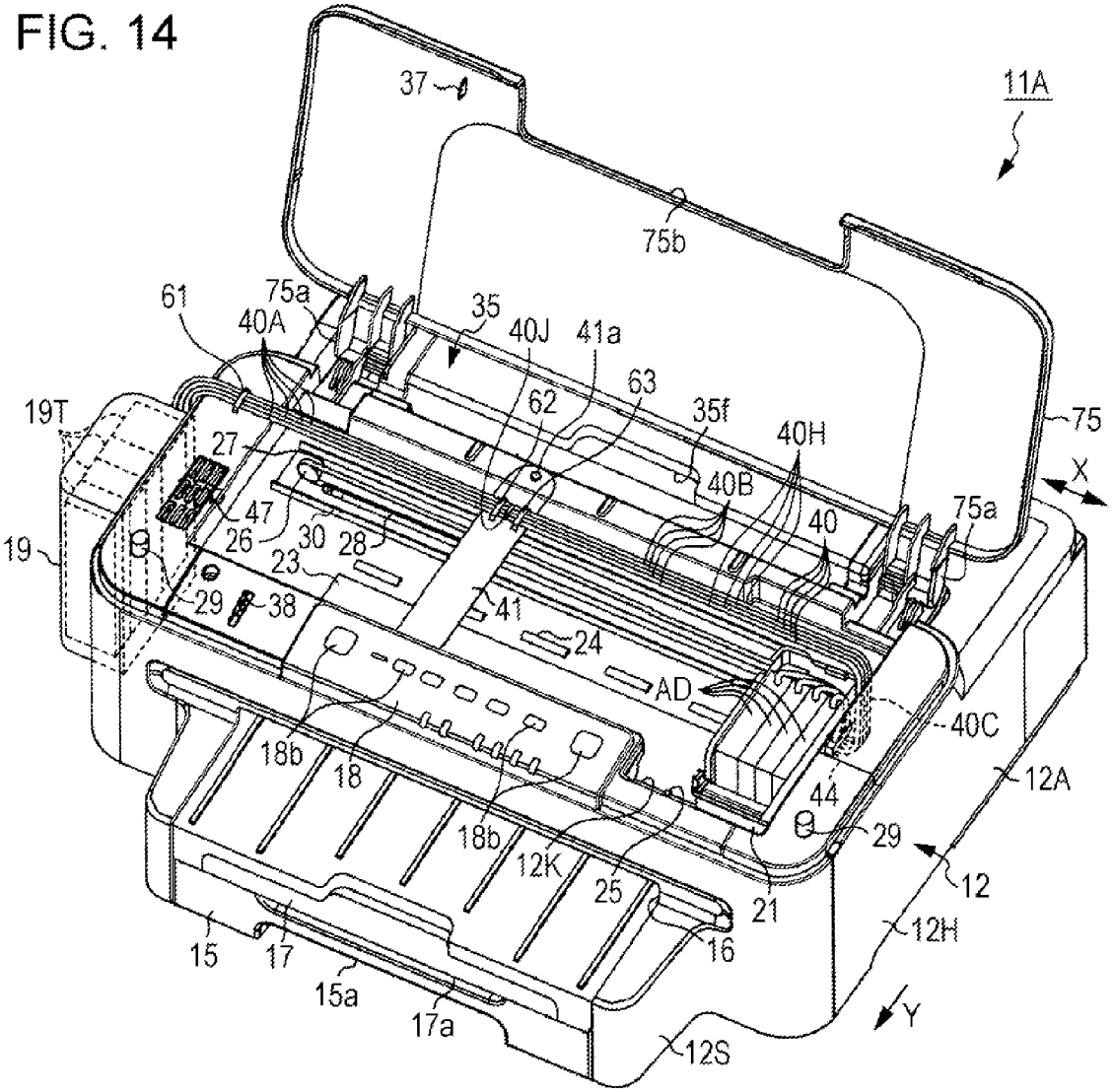
FIG. 14 is a perspective view illustrating the printer in a state of opening a lid portion.

As illustrated in FIG. 14, on the back surface of the lid portion 75, at a close position of the rotation front end side in the width direction, a projection 37 for object detection is formed to project. The projection 37, when closing the lid portion 75, is inserted into the detected concave portion 38 provided to be concaved on the upper surface of the apparatus main body 12. In the apparatus main body 12, at a position corresponding to the detected concave portion 38, a sensor (not illustrated) detecting the projection 37 inserted to the detected concave portion 38 is provided. A controller in the printer 11A, when detecting a close state of the lid portion 75, performs an instructed printing. However, when the sensor does not detect the close state of the lid portion 75, the controller is not allowed to start the printing even though there is an instructed printing.

Next, a configuration of a fifth embodiment regarding a fixing portion that fixes the ink supply tube 40 will be described with reference to FIG. 14. The fixing portion of the fifth embodiment has a configuration in which the ink supply tube 40 is fixed to the housing 12H that forms the opening portion 12K using the fixing tool. Meanwhile, it is possible to use a variety of members such as a cord, a rubber band, a clip, an adhesive tape and an adhesive as the fixing tool. That is, in the present embodiment, an example in which an adhesive tape is used as the fixing tool will be described. In addition, in descriptions of FIGS. 12 to 14, the same components as in FIG. 1 will be given the same reference numerals, and will not be appropriately described.

In the embodiment, first, a configuration of a printing unit 20 will be simply described using FIG. 14.

As illustrated in FIG. 14, the carriage 21, the liquid ejecting head 22, a support table 23, the transportation roller 24, the sheet discharge roller 25, the guide frame 30, the timing belt 27, the linear encoder 28 and the like are provided in the housing 12H.

Inks used in the liquid ejecting head 22 for the printing are supplied to the liquid ejecting head 22 from the respective ink tanks 19T in the external tank unit 19 through the respective ink supply tubes 40 and the respective adapters AD. In the tank unit 19 of the present example, four ink tanks 19T that respectively house four inks having different ink colors are housed as an example. The four ink colors are, for example, black (K), cyan (C), magenta (M) and yellow (Y).

As illustrated in FIG. 14, the ink tanks 19T are disposed on an outside of a movement region of the carriage 21, and, particularly, in the example, disposed on an outside of the housing 12H. The ink tanks 19T are provided on a left outside of the housing 12H, that is, at a location on an opposite side of a home position in the main scanning direction X when seen from a front side (a front side of the sub-scanning direction Y) of the printer 11A. In addition, one end portion of the ink supply tube 40 is connected to the ink tanks 19T, and a portion of the ink supply tube 40 on an opposite side is inserted into the movement region of the carriage 21 exposed from a location closer to the home position in the main scanning direction X of the carriage 21 through the opening portion 12K provided in the housing 12H. The other inserted end portion is connected to the adapter AD mounted on the carriage 21. The respective ink supply tubes 40 connected between the tank unit 19 and the adapter AD on the carriage 21 are installed in a state of extending almost straight along the main scanning direction X over an inside portion of the opening portion 12K when a side to which the lid portion 75 is rotatably fixed is considered as the inside.

As illustrated in FIG. 14, the long and thin plate-like support plate 41 is provided on a top surface of the housing 12H in a state of being bridged laterally so as to traverse the opening portion 12K in the sub-scanning direction Y. A length of the support plate 41 in a longitudinal direction is slightly longer than a width of the opening portion 12K in the sub-scanning direction Y. The support plate 41 is rotatably provided at an end portion using the axis portion 41*a*. Therefore, an angle formed by the longitudinal direction of the support plate 41 with the main scanning direction X becomes changeable by rotating the support plate 41 around the axis portion 41*a* in a plane in parallel with an opening surface of the opening portion 12K.

In addition, an end portion (free end) of a side opposite to the rotating center of the support plate 41 having an adjusted angle on a position fixed to a portion of the ink supply tube 40 is fixed to a upper surface portion 12U of the housing 12H using a fixing tool (for example, an adhesive tape), not shown, at a location to which a part of the ink supply tube 40 is fixed. Naturally, the free end portion of the support plate 41 having an adjusted angle may be fixed using a screw or an adhesive. Meanwhile, on the upper surface portion 12U of the apparatus main body 12, the detected concave portion 38 into which the projection 37 provided on a rear surface of the lid portion 75 is inserted when the lid portion 75 is opened is formed on a left side of the operation panel unit 18 in FIG. 14. In addition, on the upper surface portion 12U of the housing 12H, the ventilating port 47 is formed around the opening portion 12K.

In addition, on the upper surface of the housing 12H, bosses 29 having a substantially columnar shape are fixed in a state of projecting upward in a predetermined length. That is, the bosses 29 are provided in order to ensure a gap through which the ink supply tube 40 is inserted between the lid portion 75 and the printing function unit 12A by being sandwiched between the printing function unit 12A and the image reading unit 13 in a case in which the lid portion 75 is rotated in a closing direction in which the opening portion 12K is opened and closed. Meanwhile, in FIG. 14, in order to stably form the gap, two bosses 29 are provided, but one boss 29 may be provided.

Meanwhile, a middle portion of the ink supply tube 40 inserted into the gap formed using the bosses 29 as described above in the longitudinal direction is fixed to the upper surface of the housing 12H using a fixing tool. In the embodiment, an example in which the bosses are fixed using three adhesive tapes will be described. Originally, a number of adhesive tapes necessary to fix the ink supply tube 40 are used.

More specifically, the ink supply tubes 40 first extend from the tank unit 19 and is fixed by the first fixing tool 61 (for example, adhesive tape) attached at a portion disposed on the upper surface portion extending from the left side surface and the slightly back side of the apparatus main body 12 in FIG. 14. Next, the middle portion on the downstream side which is a connection side to the adapter AD rather than the ink supply tubes 40 is sequentially fixed using the second fixing tool 62 (for example, adhesive tape) and the third fixing tool 63 (for example, adhesive tape) attached to the upper surface of the support plate 41.

In addition, as illustrated in FIG. 14, a close portion to the adapter AD in the ink supply tubes 40 is bundled and held by the holding member 44 fixed to the right side surface of the carriage 21 in FIG. 14, an end portion of the downstream side rather than a position bundled by the holding member 44 is respectively connected to the supply tube (not illustrated) on the upper surface of the adapter AD.

The middle portion fixed using the first to the third fixing tools 61, 62, and 63 in the ink supply tubes 40 is restricted to move in the length direction of the ink supply tubes 40 and a direction intersecting with the length direction.

Therefore, the first to the third fixing tools 61, 62, and 63 fixing the middle portion of the ink supply tubes 40 function as an example of the fixing portion.

Then, in the embodiment, among the first to the third fixing tools 61, 62, and 63, the third fixing tool 63 fixing the middle portion of the most downstream side of the ink supply tubes 40 to the housing 12H is a fixing portion fixing a portion of the ink supply tubes 40 in the length direction to be relatively immovable with respect to the opening portion 12K. As the result, a portion between the third fixing tool 63 and the adapter AD in the length direction of the ink supply tubes 40, more accurately a portion between the third fixing tool 63 and the holding member 44 is a deformable moving unit 40H performing a follow-up deformation along the movement of the carriage 21 as illustrated in FIG. 14. In other words, the tube length of the deformable moving unit 40H is restricted by a fixed position of the third fixing tool 63.

In the example of FIG. 14, a plurality of ink supply tubes 40 are disposed in a surface shape by being substantially arranged in a row in the radial direction so that each central line is substantially positioned on the same surface. Then, the plurality of ink supply tubes 40 are curved in an arc surface shape in the middle, both side portions (tube surface) across the curved portion is disposed to extend opposite to a vertical direction in a substantially parallel way.

When the carriage 21 moves, the curved portion 40C of the ink supply tubes 40 moves by a movement distance (in other words, movement speed) of approximately half of the movement distance (that is, movement speed) of the carriage 21 in the carriage movement direction. At this time, in a course where the carriage 21 moves from the home position to the reverse home position, the ink supply tubes 40 follow the movement of the carriage 21 while moving the curved portion 40C leftward in FIG. 14. Therefore, in the course of movement of the carriage 21, the ink supply tubes 40 may smoothly supply an ink to the adapter AD on the carriage 21 through the ink supply tubes 40 without being curved or broken. It is easy to avoid a situation incurring a print failure by a reason that the ink supply tubes 40 are broken to be in contact with, for example, the sheet P or the transportation roller 24, the timing belt 27 and the like.

As illustrated in FIG. 14, in a course that the carriage 21 entirely moves the movement region, a portion contributing to formation of the curved portion 40C in the ink supply tubes 40 is a deformable moving unit 40H. Then, a portion on the upstream side of an ink supply direction rather than the curved portion 40C is a non-moving portion which does not contribute to formation of the curved portion. Here, the boundary portion of the deformable moving unit 40H and the non-deformable portion may be fixed using the fixing portion. However, in the embodiment, in order to have some room, a portion of the ink supply tubes 40 may be fixed to a position on an upstream side by a predetermined distance rather than the boundary portion. When the ink supply tubes 40 are fixed to a position greatly exceeding a predetermined distance from the boundary portion to the upstream side, a portion where a portion which does not contribute to formation of the curved portion is not fixed is long, thereby extremely avoiding a situation where the tube portion forming the deformable moving unit 40H whose shape is unstably held is broken. Of course, a portion fixing the ink supply tube 40 by the third fixing tool 63 (fixing portion) may be a boundary portion or a portion exceeding a predetermined distance from the boundary portion to the upstream side.

Then, in the embodiment, the third fixing tool 63 fixes a portion on the upstream side of the ink supply tubes 40 rather than a substantially central portion in the movement region of the carriage 21 in the main scanning direction X. Therefore, the ink supply tubes 40 have the left side portion slightly shorter than the right side portion in FIG. 14, and both sides of the movement range of the carriage 21 centered on the fixing portion by the third fixing tool 63 have a substantially the same length.

Incidentally, as illustrated in FIG. 14, in the embodiment, it is preferable that the ink supply tubes 40 be configured to have a plurality of tubes 40A and 40B connected through the joint 40J in the longitudinal direction. The joint 40J, as illustrated in FIG. 14, two tubes 40A and 40B are connected on the support plate 41 of the ink supply tubes 40. Each tube 40A and 40B connected to both sides of the joint 40J is fixed by the second fixing tool 62 and the third fixing tool 63, so that the tubes 40A and 40B are unlikely to deviate from the joint 40J.

Figure 5:
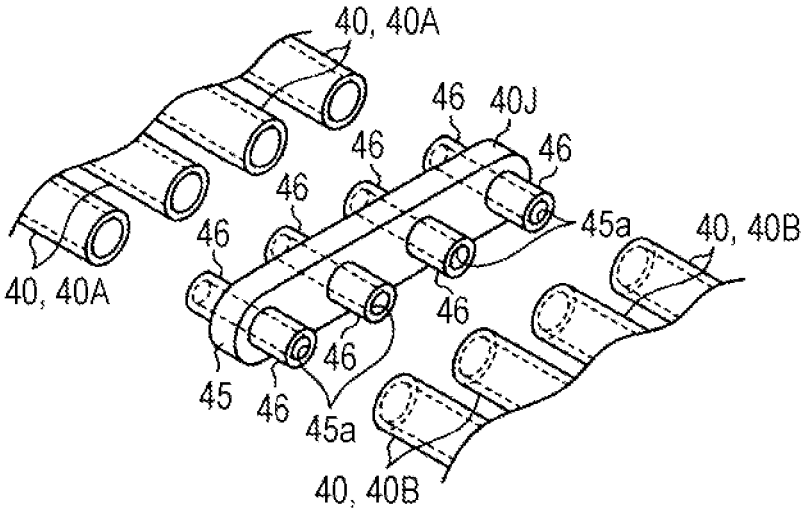
FIG. 5 is a perspective view illustrating another example of the joint.

The joint 40J used in the embodiment includes the joint 40J illustrated in FIG. 4 and the joint 40J illustrated in FIG. 5. The joint portion of the tubes 40A and 40B connected through the joint 40J is positioned at a portion in addition to the deformable moving unit 40H of the ink supply tubes 40 as illustrated in FIG. 14. Therefore, a location connected using the joint 40J of the ink supply tubes 40 is not the curved portion 40C, so that the tube is unlikely to deviate from the joint 40J.

According to a fifth embodiment described above, effects (1) to (11) in the first embodiment are obtained in the same manner.

Sixth Embodiment

Next, a configuration of a sixth embodiment according to the fixing portion fixing the ink supply tubes 40 will be described referring to FIG. 15. The sixth embodiment is an example applying a configuration pulling around the ink supply tubes 40 in the second embodiment to the printer 11A. In description of FIG. 15, the same numbers are given to the same configuration members in FIGS. 12 to 14, and the description is omitted. In addition, the joint 40J of the ink supply tubes 40 is not illustrated in FIG. 15.

Figure 15:
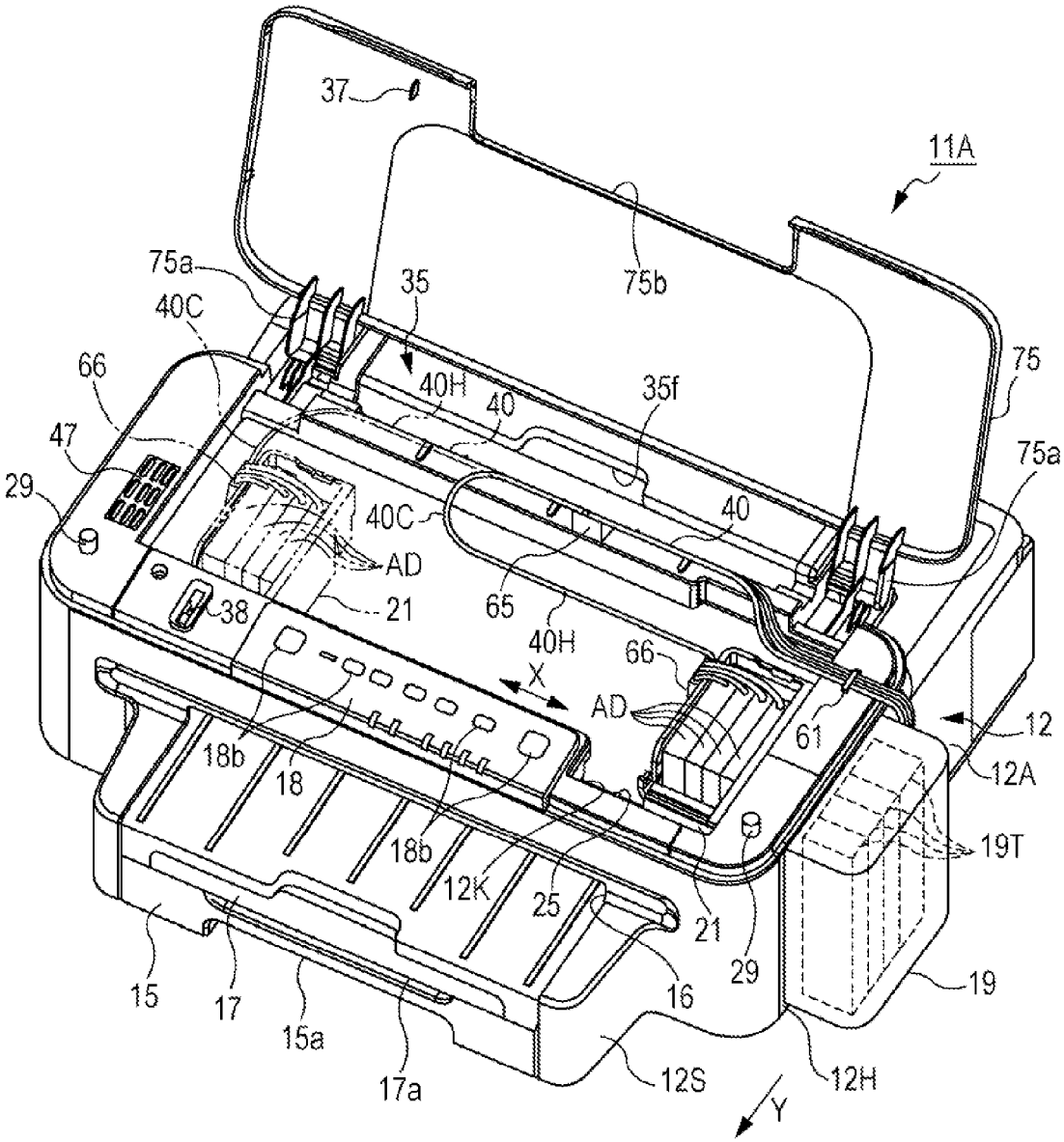
FIG. 15 is a perspective view illustrating the printer including the pull-around structure of the ink supply tubes according to a sixth embodiment.

An example of the fixing portion of the sixth embodiment, as illustrated in FIG. 15, is an inclined block 65 fixed to a portion of the peripheral portion of the opening portion 12K on the upper surface portion of the housing 12H. The inclined block 65 holds a plurality of ink supply tubes 40 inclined at a predetermined angle on a surface (tube surface) which is through each central line with respect to the opening surface of the opening portion 12K. The holding member 66, fixed to a side surface of the carriage 21 in a state where a portion of the adapter AD side of the ink supply tubes 40 is bundled, inclines and holds a portion extending along the main scanning direction X from the holding member 66 to the upstream side so as to be inclined in the same direction as inclined by the inclined block 65.

In a detailed configuration, as illustrated in FIG. 8, the inclined block 65 has a triangular shape, and the inclined surface 65*a* is fixed to the upper surface portion 12U in a direction extending in the main scanning direction X. A plurality (four in the example) of ink supply tubes 40 are fixed to the inclined surface 65*a* by the third fixing tool 63 (for example, adhesive tape) in a state of being arranged in a row.

On the other hand, as illustrated in FIG. 8, the holding member 66 fixed on the side surface of the carriage 21 is formed on the inclined surface 66*a* where a surface of a side opposite to the inclined block 65 is in parallel to the inclined surface 65*a*. Therefore, a plurality of tubes bundled by the holding member 66 extending from the adapter AD are held in a state of being arranged in a row so as to form a tube surface in substantially parallel to a tube surface of the inclined block 65 side along the inclined surface 66*a*. Then, the deformable moving unit 40H is formed in a state where both sides of the tube surface are obliquely oppose each other across the curved portion 40C in a substantially parallel way.

Therefore, even in a configuration where a space for pulling around the ink supply tubes 40 cannot be ensured in the opening portion 12K of the housing 12H, it is possible to form the deformable moving unit 40H so as to form a tube surface obliquely opposite to the opening surface of the opening portion 12K in a substantially parallel way. It is possible to obtain the same effects as (1) to (11) in the first embodiment.

Seventh Embodiment

Next, a configuration of a seventh embodiment according to the fixing portion fixing the ink supply tubes 40 will be described referring to FIG. 16. The seventh embodiment is an example which applies a structure of pulling around the ink supply tubes 40 in the third embodiment to the printer 11A. In description of FIG. 16, the same numbers are given to the same configuration members in FIGS. 12 to 14, and the description is omitted. In addition, the joint 40J of the ink supply tubes 40 is not illustrated in FIG. 16.

Figure 16:
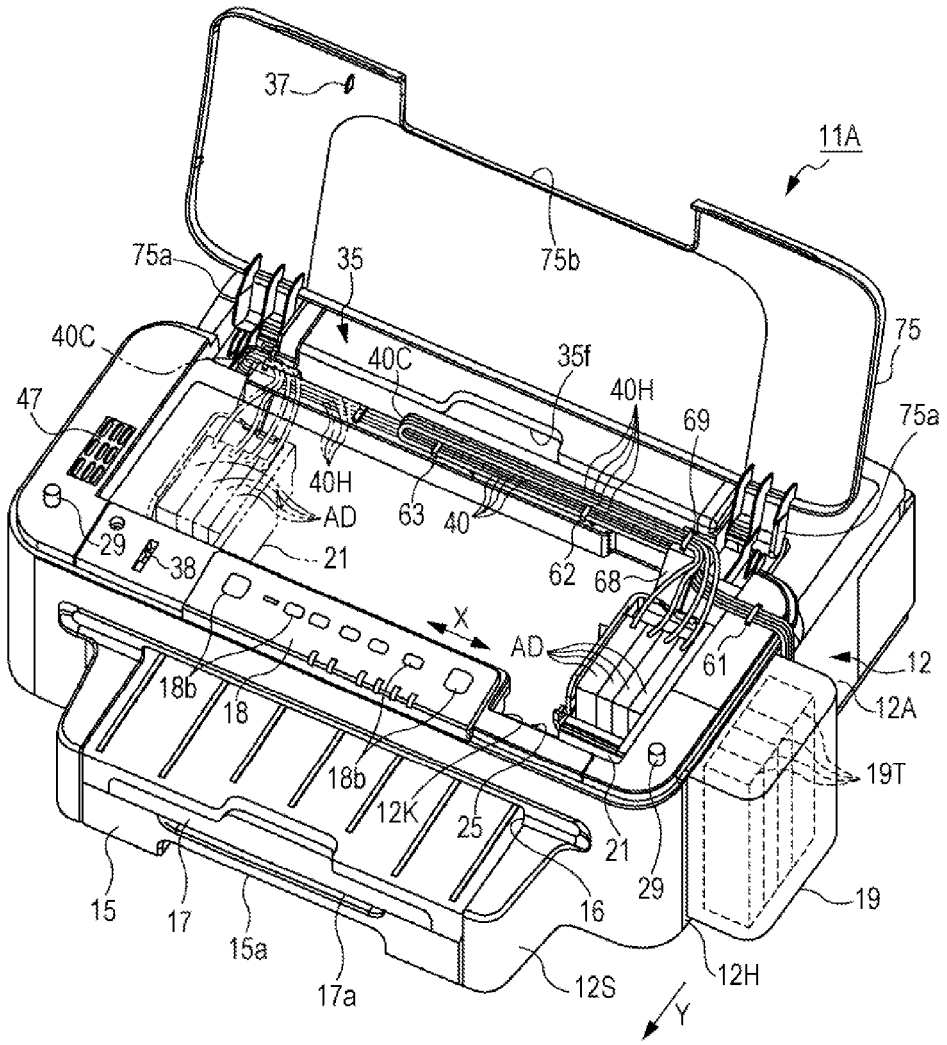
FIG. 16 is a perspective view illustrating the printer including the pull-around structure of the ink supply tubes according to a seventh embodiment.

An example of the fixing portion in the seventh embodiment, as illustrated in FIG. 16, is the third fixing tool 63 (for example, adhesive tape) fixing a portion of the ink supply tubes 40 to the peripheral portion of the opening portion 12K on the upper surface portion of the housing 12H. Specifically, the ink supply tubes 40 first extends from the tank unit 19 and is fixed by the first fixing tool 61 to a portion extending from the right side surface and the slightly back side to the main scanning direction X in FIG. 16 of the apparatus main body 12 and disposed on the upper surface portion. Next, the middle portion of the downstream side which is rather a connection side to the adapter AD in the ink supply tubes 40 is sequentially fixed by the second fixing tool 62 and the third fixing tool 63 to a portion disposed on the upper surface portion.

In addition, as illustrated in FIG. 16, a close portion to the adapter AD in the ink supply tubes 40 is fixed to the front end portion upper surface of the support member 68 obliquely extending from the back surface portion of the carriage 21 to rearward upside (backward upside) in a state of being bundled using the adhesive tape 69. Then, the end portion of the downstream side rather than a location fixed by the adhesive tape 69 to the support member 68 in the ink supply tubes 40 is respectively connected to the supply tube (not illustrated) on the upper surface of the adapter AD.

A portion of the ink supply tubes 40 is fixed to a position of the further upstream side than the boundary portion of the non-moving portion as much as a predetermined distance by the third fixing tool 63, and accordingly the deformable moving unit 40H is formed at further downstream side than the fixed position thereof.

Figure 9:
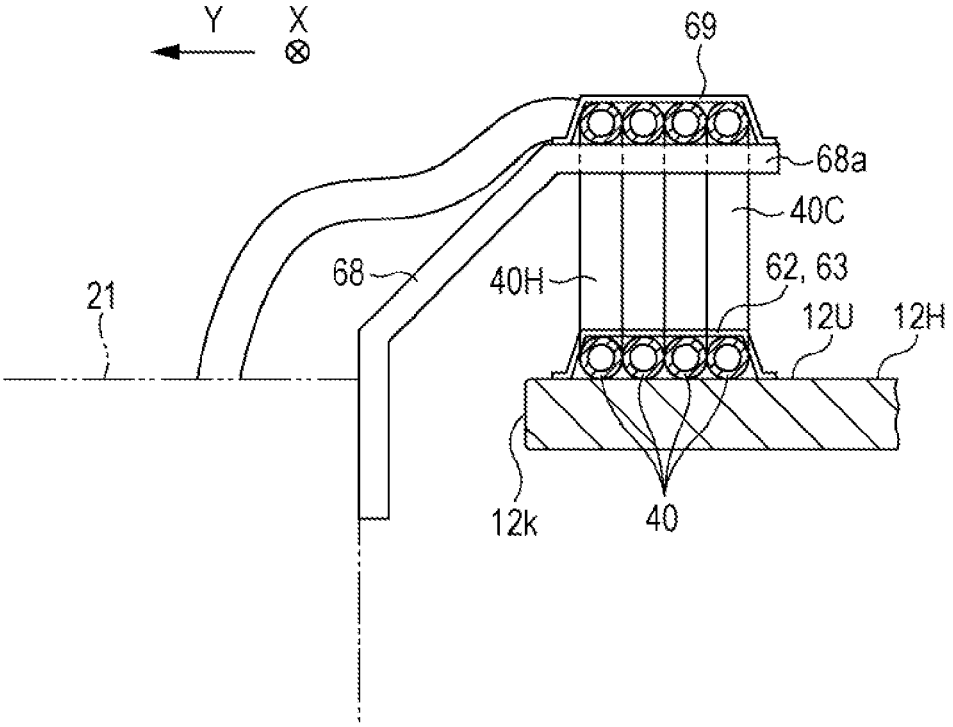
FIG. 9 is a schematic side cross-sectional view illustrating the pull-around structure of the ink supply tubes according to a third embodiment.

Specifically, as illustrated in FIG. 9, in the back surface portion of the carriage 21, a support member 68 where the base end portion is fixed has the support portion 68*a* extending obliquely upward to the rear side and extending rearward in a substantially parallel way. The support portion 68*a* is positioned at a height spaced away as much as a predetermined space distance from the upper surface of the peripheral portion of the opening portion 12K. On the upper surface of the support portion 68*a*, a portion of the plurality of ink supply tubes 40 is fixed by the adhesive tape 69.

Therefore, a plurality of tube portions (tube surface) disposed on the upper surface of the rear side peripheral portion along the opening portion 12K in the upper surface portion 12U of the housing 12H, and a plurality of tube portions (tube surface) supported in the upper surface of the support portion 68*a* which is the front end portion of the support member 68 are positioned to be opposite to each other in a vertical direction. Therefore, in a course of moving a space between a position of the carriage 21 (home position in the example) illustrated using a solid line in FIG. 16 and a position of the carriage 21 illustrated using the two-dot chain line in FIG. 16 (end position on reverse home position side in the example), the deformable moving unit 40H is deformed by displacing the curved portion 40C in the main scanning direction X.

According to the configuration, even in a configuration in which a space for pulling around the ink supply tubes 40 in the opening portion 12K of the housing 12H, the ink supply tubes 40 may be disposed on the upper side of the housing 12H, so that it is possible to supply an ink while inhibiting the ink supply tubes 40 from being broken from the external tank unit 19 to each adapter AD on the carriage 21. It is possible to obtain the same effect as (1) to (11) in the first embodiment.

Eighth Embodiment

Figure 17:
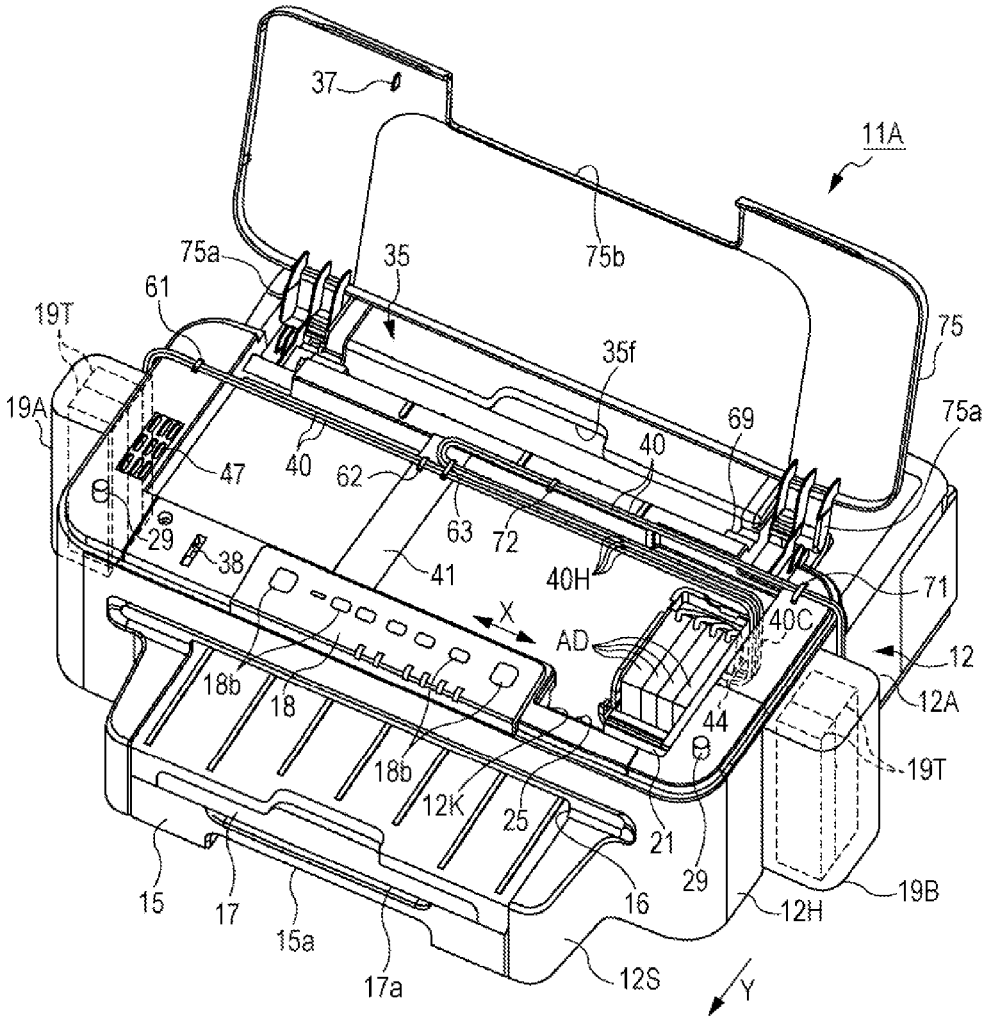
FIG. 17 is a perspective view illustrating the printer including the pull-around structure of the ink supply tubes according to an eighth embodiment.

Next, a configuration of an eighth embodiment according to the fixing portion fixing the ink supply tubes 40 will be described referring to FIG. 17. The eighth embodiment is an example which applies a structure of pulling around the ink supply tubes 40 in the fourth embodiment to the printer 11A. In description of FIG. 17, the same numbers are given to the same configuration members in FIGS. 12 to 14, and the description is omitted. In addition, the joint 40J of the ink supply tubes 40 is not illustrated in FIG. 17.

An example of the fixing portion in the eighth embodiment is basically the same as in FIG. 3. In the embodiment, as illustrated in FIG. 11, a plurality ((N+M), for example four) of ink supply tubes 40 extending from each of a plurality of adapters AD are divided into N (for example, two) and the remaining M (for example, two) (Here, N and M are natural numbers). Then, by connecting an end portion of N ink supply tubes 40 to each ink tank 19T in the tank unit 19A disposed outside the left side (reverse home position side) of the housing 12H, an end portion of M ink supply tubes 40 is connected to each ink tank 19T in the tank unit 19B disposed outside the right side (home position side) of the housing 12H.

N among the plurality of ink supply tubes 40 are fixed by the first fixing tool 61 (for example, adhesive tape) to the left end portion of the upper surface portion 12U of the housing 12H, and furthermore a portion of the downstream side thereof is fixed to the upper surface of the support plate 41 by the second fixing tool 62 and the third fixing tool 63. On the other hand, the remaining M ink supply tubes 40 are fixed by fixing tools 71 and 72 (for example, adhesive tape) to the peripheral portion of the rear side along the opening portion 12K in the upper surface portion 12U of the housing 12H, a direction of pulling around a tube at a portion of the downstream side is inverted to an opposite direction, and a portion after being inverted is fixed to the upper surface of the support plate 41 by the third fixing tool 63. Then, four ink supply tubes 40 fixed to the upper surface of the support plate 41 by the third fixing tool 63 has the downstream side portion that extends in the same direction (horizontal direction in FIG. 17), and is bundled by the holding member 44 fixed to the right side surface of the carriage 21, and then each of other end portions is connected to a supply tube (not illustrated) having each end portion projecting from the upper surface of the adapter AD. In the embodiment, both end portions of the support plate 41 in the longitudinal direction are fixed using a fixing method of any one of an adhesive and a screw. Of course, similar to the first embodiment, by supporting one end portion of the support plate 41 so as to rotate around the screw 43, a configuration where the other end portion thereof is fixed using a known fixing tool such as adhesive tape and the like may be provided. Even if the plurality of ink supply tubes 40 are divided at the left and right and pulled around, it is possible to obtain substantially the same effects as in the fifth embodiment.

The above-mentioned embodiment may be changed to another embodiment as follows.

Figure 18:
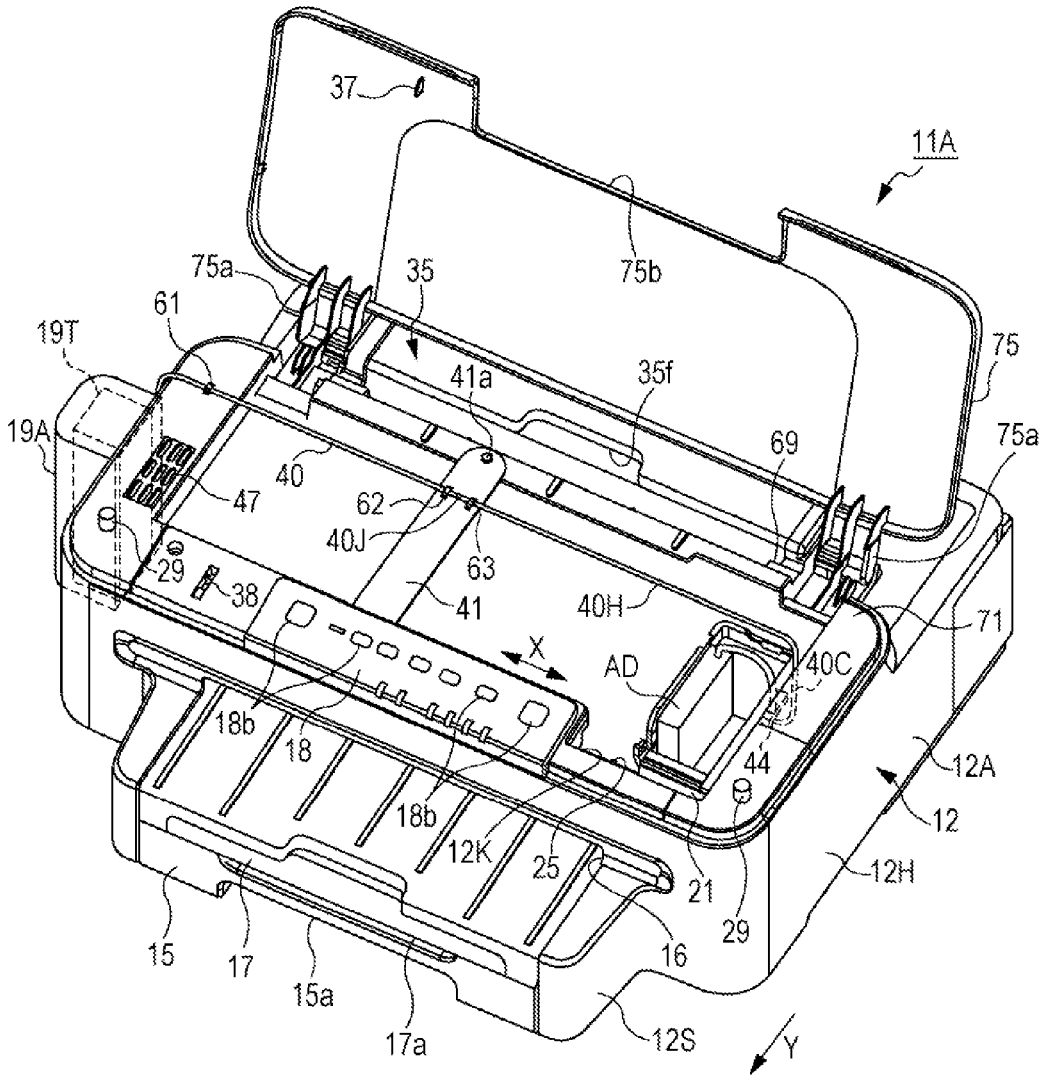
FIG. 18 is a perspective view illustrating the printer including a pull-around structure of one ink supply tube.

In the fifth to the eighth embodiments, the ink supply tubes 40 are described to be multiple. However, when one ink tank 19T is included in the printer 11A, a configuration supplying an ink to the liquid ejecting head 22 side from the ink tank 19T side through one of the ink supply tubes 40 may be provided. As an example, in a configuration of pulling around the ink supply tubes 40 in the fifth embodiment, an example of one of the ink supply tubes 40 will be described using FIG. 18. As illustrated in FIG. 18, one of the ink supply tubes 40 extending from the ink tank 19T is fixed by the second fixing tool 62 and the third fixing tool 63 at a portion supported by the support plate 41. Then, the other end portion of the ink supply tubes 40 is connected to the adapter AD mounted on the carriage 21. For example, if black ink is contained in the ink tank 19T, a lot of black-and-white printings may be performed. Of course, in the sixth to the eighth embodiment, a configuration of pulling around one of the ink supply tubes 40 may be adapted.

In the above-mentioned first to the fourth embodiments, when the image reading unit 13 is rotated in a state in which the image reading unit 13 closes the opening portion 12K of the printing function unit 12A, in a case where a projection unit projecting to the printing function unit 12A side in the swing direction of the image reading unit 13, it is preferable that the ink supply tubes 40 be disposed at an avoidance position not crushed by the projection unit.

The support member does not need to have the length cross-cutting the opening portion 12K, is shorter than the width in the sub-scanning direction Y of the opening portion 12K, and may be used as a cantilever. In this case, a position attaching a cantilever type of support member to the upper surface portion 12U may be at a position either the upstream side or the downstream side across the opening portion 12K in the sub-scanning direction Y of the upper surface portion 12U.

In each embodiment above-mentioned, a position of a fixing portion of the ink supply tubes 40 fixed by the third fixing tool 63 does not need to be a substantially central portion of the movement region of the carriage 21. In short, it may be a position where the ink supply tubes 40 do not interfere with the movement of the carriage 21.

It is sufficient that the support member may be provided so as to be displaced in a moving direction (main scanning direction X) of the carriage 21. For example, the support member may be slidably provided in a moving direction. Furthermore, there may be no problem if the displacement direction may be in a vertical direction or in an oblique direction, not in a horizontal direction.

In each of the embodiments described above, the fixed position of the boss 29 may be another position. In addition, the shape of the boss 29 also is not limited to the cylindrical shape. It may have a polygonal shape.

In each of the embodiments described above, it may be configured that the adapter AD is not mounted on the carriage 21. That is, it may have a configuration that the ink supplied from the ink tank 19T provided on the outside of the printing function unit 12A via the ink supply tubes 40 may be supplied to the liquid ejecting head 22 side without passing through the adapter AD.

In each of the embodiments described above, the ink tank 19T may not be necessarily positioned on the outside of the apparatus main body 12 (printing function unit 12A). For example, if it may be the outside of the movement region of the carriage 21, there may be no problem if it is positioned inside the apparatus main body 12. In this case, the boss 29 is not necessarily fixed.

In each of the embodiments described above, the ink tank 19T may be configured to be mounted on the apparatus main body 12 (printing function unit 12A) or the image reading unit 13 using the fixing member (for example, screws or adhesives). In addition, it is possible to make the mounting position be a position of right and left side wall portion or the back surface seen from the front side of the sub-scanning direction Y (front surface side). Alternately, the position may be the upper surface of the automatic manuscript supply device 14.

In the printer 11 in the first to the fourth embodiments described above, the cover member disposed on the upper portion of the printing function unit 12A may be a member that covers at least a part of the opening portion 12K, without including the image reading unit 13 and the automatic manuscript supply device 14.

Ninth Embodiment

Figure 19:
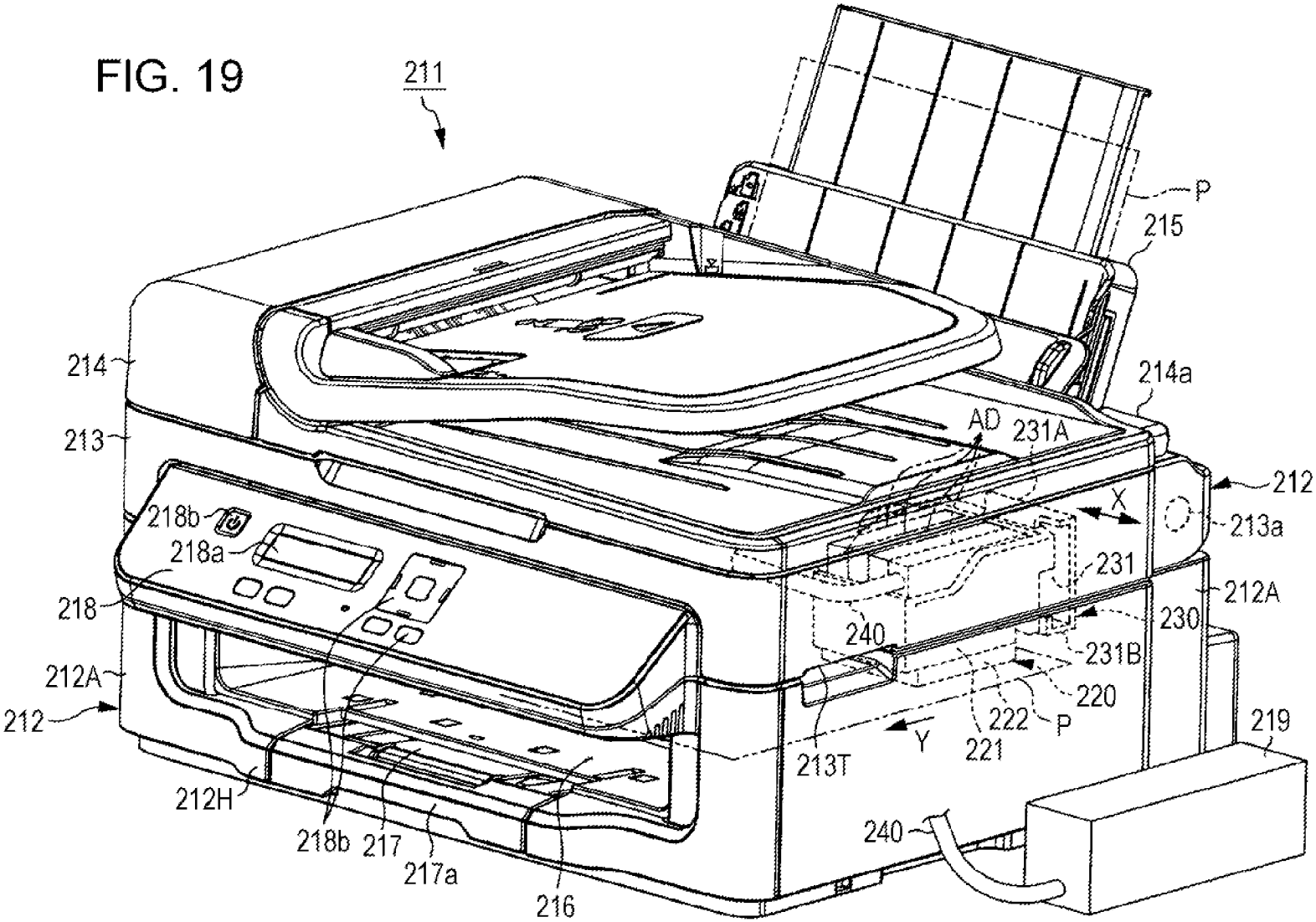
FIG. 19 is a perspective view of the printer according to a ninth embodiment.

As illustrated in FIG. 19, the printer 211 as the liquid ejecting apparatus in a ninth embodiment includes the apparatus main body 212 showing a substantially rectangular shape and an ink tank 219 as an example of the liquid containing unit showing a substantially rectangular shape as a separate body from the apparatus main body 212.

In the apparatus main body 212 on the side where ink is supplied, in the lower side which is a gravity direction, the printing function unit 212A as an example of the housing unit in which the printing unit 220 is embedded is disposed, and in the upper side which is an antigravity direction side, the image reading unit 213 in which the image reading mechanism such as a scanner which reads the manuscript (image) is disposed as an example of the cover member. The image reading unit 213 has a configuration so as to rotate (displacement) around the rotation axis 213*a* provided on one side end (rear side) of the apparatus main body 212, and such that the side end of the opposite side (front side) to the rotation axis 213*a* in the apparatus main body 212 is lifted. That is, in the housing side surface (both side surface of the right and left) of the image reading unit 213, the hand grip portion 213T is concavely provided, and the user of the printer 211 can lift the image reading unit 213 by inserting the hand into the hand grip portion 213T, at the time of maintenance, for example. By the lifting, the opening portion 212K (refer to FIG. 20A) is exposed, which is provided on the upper portion of the printing unit 220 and causes at least a part of the movement region of the carriage 221 which is disposed to reciprocate in the printing function unit 212A to be exposed.

Furthermore, the automatic manuscript supply device 214 which automatically supplies the read manuscript with respect to the image reading unit 213 is disposed on the upper portion of the image reading unit 213. The automatic manuscript supply device 214 has a configuration so as to rotate (displacement) around the rotation axis 214*a* provided on one side end (rear side) of the apparatus main body 212, and such that the side end of the opposite side (front side) to the rotation axis 214*a* in the apparatus main body 212 is lifted. By the lifting of the automatic manuscript supply device 214, the user can manually supply the read manuscript with respect to the image reading unit 213.

In addition, on the rear side of the apparatus main body 212, the loading table 215 capable of repeatedly loading a plurality of sheets P is provided. The sheet P loaded on the loading table 215 is transported one by one to the printing unit 220 provided on the printing function unit 212A in a direction from the rear to the front, and the printing is performed with respect to the sheet P in the printing unit 220. That is, the sheet P is transported from the loading table 215 to the printing unit 220 by a not illustrated transportation mechanism, the image is printed by ejecting the ink on the sheet P from the liquid ejecting head 222 which reciprocates by the moving mechanism which is not illustrated along the direction (called as main scanning direction X) crossing the transportation direction (called as sub-scanning direction Y) of the sheet P in the printing unit 220. The sheet P on which the image is printed by the printing unit 220 is further transported to the front (sub-scanning direction Y) from the printing unit 220, to be discharged from the sheet discharge port 216 provided on the front surface of the apparatus main body 212 (printing function unit 212A).

On the lower side of the discharge port 216 in the apparatus main body 212 (printing function unit 212A), the tray accommodation unit 212H is configured, in which the stacker 217 is accommodated as an example of a discharge tray that receives the sheet P discharged from the sheet discharge port 216, by the housing portion protruded to be formed in a discharging direction of the sheet P (here, the sub-scanning direction Y). By the protrusion, the stacker 217 can easily be pulled out from the apparatus main body 212 by the grip portion 217*a*. Thus, the stacker 217 is pulled out from the apparatus main body 212 depending on the length in a discharge direction of the sheet P (transportation direction).

On the other hand, on the upper side of the sheet discharge port 216 in the apparatus main body 212 (printing function unit 212A), the operation panel unit 218 for causing the printing operation to be performed in the printing unit 220 is provided. The operation panel unit 218 is configured to have the housing portion showing the inclined surface in which the lower side of the operation panel unit is protruded to the discharge direction side of the sheet P than the upper side. In the inclined surface, the operation member for operating at the time of performing the printing are prepared, such as the display unit 218*a* for displaying the menu screen (for example, liquid crystal display) or an operation button 218*b* like a power button. Thus, the operation by the user can easily be performed.

Now, the printing unit 220 included in the printer 211 in the embodiment includes a carriage 221 as a moving body which reciprocates in the main scanning direction X, and the liquid ejecting head 222 which ejects the ink in the carriage 221 is included. The carriage 221 is guided by a guide frame 230 which is a plate member extended along the main scanning direction X, and is provided so as to be movable (reciprocately movable) in the main scanning direction X. That is, the guide frame 230 has a rail portion 231 in which an upper rail 231A and a lower rail 231B are provided by the member being bent in substantially U-shape in the both side end portion of the upper and lower portion of the plate member which is perpendicular to the main scanning direction X. The rear end side of the carriage 221 is supported by the upper rail 231A and the lower rail 231B, and guided to the upper rail 231A and the lower rail 231B in a cantilevered state, and reciprocates on the rail portion 231 along the main scanning direction X. Then, from the liquid ejecting head 222 included in the reciprocately moving carriage 221, the ink supplied by the ink supply tubes 240 is ejected, and the printing with respect to the sheet P is performed.

In the printer 211 in the embodiment, a relay adapter AD which relays the ink supplied via the ink supply tubes 240 to the liquid ejecting head 222 is mounted in the carriage 221, the ink is supplied to the liquid ejecting head 222 from the mounted relay adapter AD. Therefore, the ink supply tubes 240 forms a flow path of the ink such that the ink can flow between the ink tank 219 and the liquid ejecting head 222, by connecting the ink supply tubes 240 which supplies the ink from the ink tank 219 in a state that the ink is contained, to the relay adapter AD.

Here, it is assumed that one type of ink (for example, a black ink) is supplied from the ink tank 219, and one type of relay adapter AD corresponding to such one type of ink is mounted on the carriage 221. Of course, in a case where a plural types of ink is supplied from the ink tank 219, the plural number of relay adapters AD depending on the number of types (maximum four in FIG. 19) are mounted.

Next, the configuration of the fixing portion that fixes the ink supply tubes 240 in the ninth embodiment will be described with reference to FIGS. 20A and 20B, FIG. 21, and FIG. 22. The fixing portion in the ninth embodiment has a configuration in which the ink supply tubes 240 are fixed by the fixing tool with respect to the housing member forming the opening portion 212K. A variety of members such as a string, a rubber band, a clip, an adhesive tape, and adhesive can be used as the fixing tool. Incidentally, the embodiment will be described as a case using the adhesive tape. In addition, in describing FIGS. 20A and 20B, FIG. 21, and FIG. 22, the same configuration members as FIG. 19 will be referenced by the same numerals, and the descriptions thereof will not be repeated. In addition, FIG. 21 is illustrated in a state in which the image reading unit 213 and the automatic manuscript supply device 214 are removed.

Figure 20A:
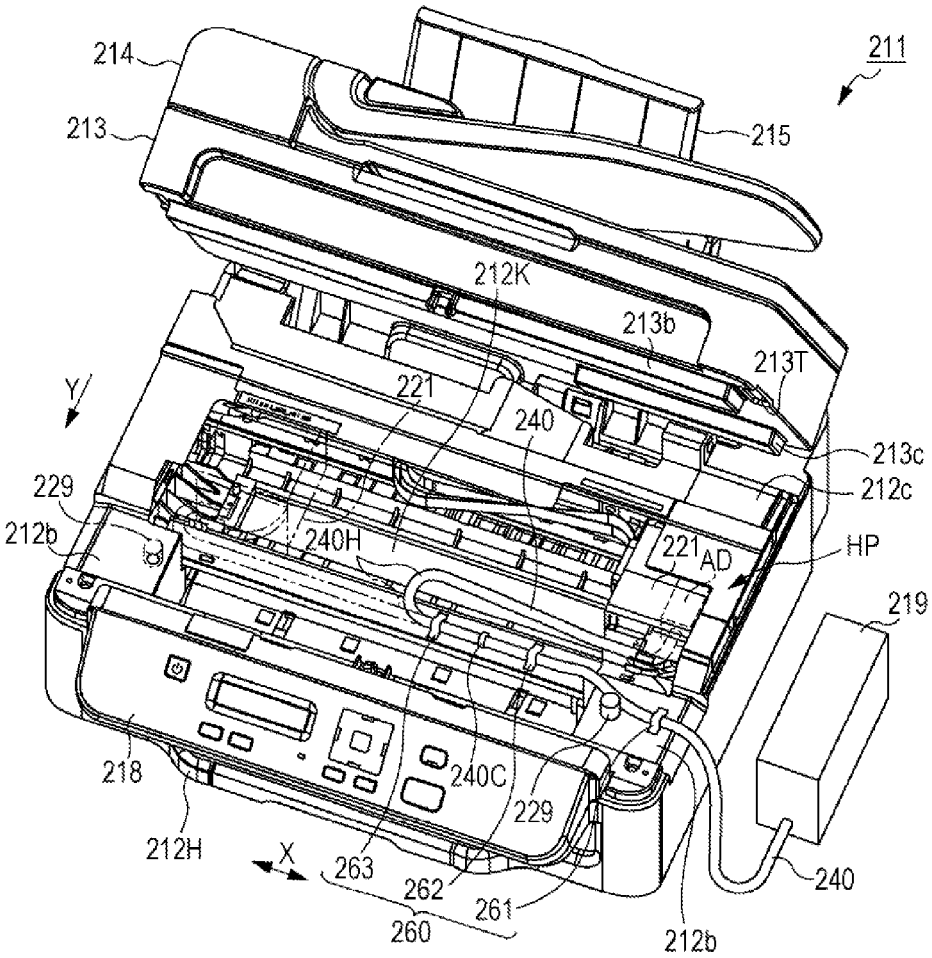
FIG. 20A is a perspective view illustrating a state where an image reading unit is lifted.
Figure 21:
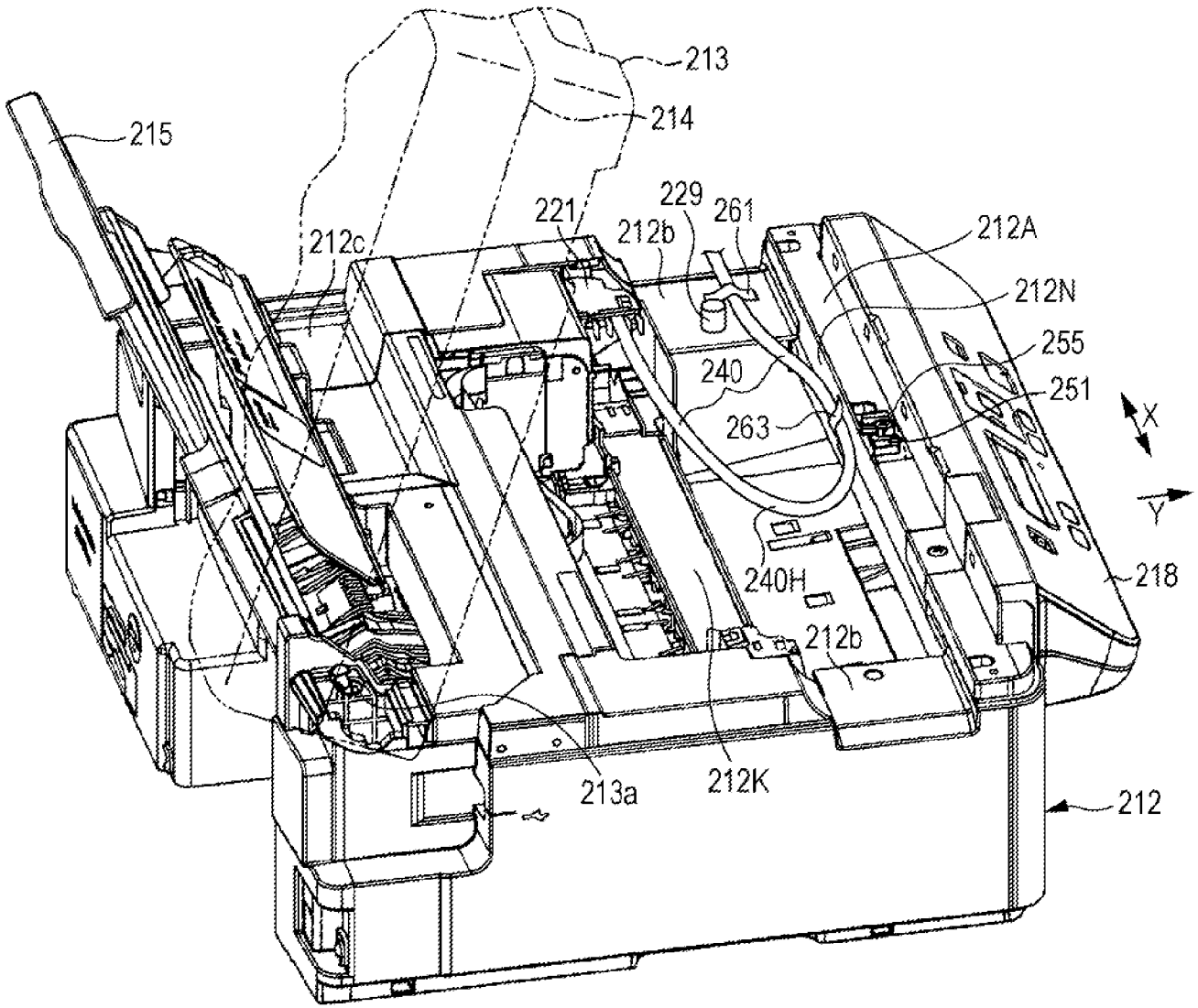
FIG. 21 is a perspective view illustrating a state where the ink supply tubes are fixed to the inside of a housing according to the ninth embodiment.

As illustrated in FIG. 20A, the ink tank 219 which contains the ink ejected from the liquid ejecting head 222 is disposed outside the right housing when viewed from the front side of the sub-scanning direction Y with respect to the apparatus main body 212. That is, the ink tank 219 is disposed on the position close to the home position HP in the main scanning direction X which is the outer side of the movement region of the carriage 221. Then, one end side of the ink supply tubes 240 which functions as the flow path of the ink contained in the ink tank 219, is connected to the ink tank 219. In addition, another end side of the ink supply tubes 240 is inserted, from the position close to the home position HP in the main scanning direction X of the carriage 221, into movement region of the carriage 221 exposed through the opening portion 212K provided on the printing function unit 212A, and connected to the relay adapter AD mounted on the carriage 221.

In addition, on the upper surface of the printing function unit 212A, in a case where the side which rotatably fixes the image reading unit 213 is the rear side, to the front side of the opening portion 212K, on the position corresponding to the projection unit 213*b* and 213*c* protruding on the printing function unit 212A in the oscillation direction of the image reading unit 213, the concave-shaped portion 212*b* and 212*c* are formed. The concave-shaped portion 212*b* is provided as a housing member forming the opening portion 212K, the boss 229 having a substantially cylindrical shape is fixed upward with a predetermined length in the concave-shaped portion 212*b*. That is, in a case where the image reading unit 213 is rotating in a direction closing the opening portion 212K of the printing function unit 212A, by being interposed between the concave-shaped portion 212*b* and the image reading unit 213, the boss 229 is provided so as to secure a void to be inserted through the ink supply tubes 240 between the image reading unit 213 and the opening portion 212K of the printing function unit 212A.

Figure 20B:
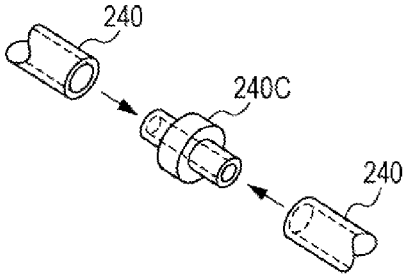
FIG. 20B is a perspective view illustrating a joint of the ink supply tubes.

In the upper surface of the printing function unit 212A, the concave-shaped portion 212*b* is provided on both end portions in the main scanning direction X respectively, the boss 229 is fixed to at least one end, that is, to the right side when viewed from the front side of the sub-scanning direction Y in FIG. 20A and FIG. 20B. Of course, in order to stably form the void, as illustrated in FIG. 20A by the two-dot chain line, it may preferable to fix the boss 229 to the left side of the concave-shaped portion 212*b* when viewed from the front side of the sub-scanning line Y.

Now, The middle part in a longitudinal direction of the ink supply tubes 240 which is inserted through the void formed by the boss 229 in this manner, and inserted into the apparatus main body 212 is fixed to the housing member of the printing function unit 212A by the adhesive tape. In the embodiment, the description is made as an example of being fixed using three adhesive tapes. Of course, the necessary number of adhesive tapes is used in fixing the ink supply tubes 240.

Specifically, the ink supply tubes 240, firstly in the housing member of the concave-shaped portion 212*b*, is fixed by the pasted first adhesive tape 261. Next, the middle part in the longitudinal direction of the ink supply tubes 240 is fixed sequentially, by the second adhesive tape 262 and the third adhesive tape 263 to which the connected side of the ink supply tubes 240 to the relay adapter AD is pasted to the lower portion of the opening portion 212K. Hereinafter, in the description below, in a case where the first to third adhesive tapes 261 to 263 are distinguished, the adhesive tapes will be simply called adhesive tape 260.

In the middle part of the ink supply tubes 240 fixed by the adhesive tape 260, by the adhesive tape 260 being abutting the outer surface of the ink supply tubes 240, the ink supply tubes 240 are fixed in a state where moving in a length direction and in a direction crossing the length direction is regulated. Therefore, the middle part of the ink supply tubes 240 fixed by the adhesive tape 260 functions as an example of the fixing portion.

Then, in the embodiment, the middle part of the ink supply tubes 240 fixed by the third adhesive tape 263 is the fixing portion that relatively immovably fixes a portion of the ink supply tubes 240 in the length direction with respect to the opening portion 212K, that is, the fixing portion by the third adhesive tape 263. As a result, a portion between the third adhesive tape 263 in the length direction of the ink supply tubes 240 and the relay adapter AD, has a curved shape which is curved in the substantially vertical direction as illustrated in FIG. 20A and FIG. 20B, and becomes a deformable moving unit 240H which performs a follow-up deformation along a movement of the carriage 221. In other words, The length of the tubes of the deformable moving unit 240H is regulated by the fixed position of the third adhesive tape 263. Then, in the embodiment, the fixing portion by the third adhesive tape 263 is provided on the substantially center part of the movement region of the carriage 221 in the main scanning direction X, the ink supply tubes 240 have the substantially same length in both sides of moving range of the carriage 221 having a fixing portion as the center.

Incidentally, as illustrated in FIG. 20B, in the embodiment, the ink supply tubes 240 may have a configuration in which a plurality of tubes are connected via the joint 240C that links between the tubes in the length direction thereof. The joint 240C is provided on a plurality of positions depending on the number of tubes linked between the ink tank 219 and the carriage 221, and causes the ink to flow through the linked tubes. Incidentally, in the embodiment, as illustrated in FIG. 20B as an example, the joint 240C has a through-hole portion, and has a structure in which the cylindrical shape portion to which the tubes are inserted are formed. A seam in which two tubes are linked via the joint 240 is formed in a location in the deformable moving unit 240H of the ink supply tubes 240 as illustrated in FIG. 20A.

Next, as illustrated in FIG. 21, in the present embodiment, a fixing portion may be configured by pasting the third adhesive tape 263 which fixes the ink supply tubes 240 to the inner side surface of the housing member which forms the opening portion 212K. Specifically, in the front side (rear side) of the operation panel unit 218 which is the front side (front side) in the sub-scanning direction Y of the printing function unit 212A, the position determination member 251 that determines the position of the image reading unit 213 with respect to the printing function unit 212A is fixed on the horizontal surface by the fixing screws 255. An inner side surface 212N which falls to the direction of gravity from the end portion of the opening portion 212K side in the horizontal surface on which the position determination member 251 is fixed. The ink supply tubes 240 are fixed to the inner side surface 212N by the third adhesive tape 263.

Therefore, in the configuration of the fixing portion illustrated in FIG. 20A and FIG. 20B, the deformable moving unit 240H of the ink supply tubes 240 has a curved shape which is curved along the substantially vertical direction. However, in the configuration of the fixing portion illustrated in FIG. 21, the deformable moving unit 240H of the ink supply tubes 240 has a curved shape which is curved along the substantially horizontal direction. In the configuration of the fixing portion illustrated in FIG. 21, the third adhesive tape 263 is pasted on the position corresponding to the substantially center part in the movement region of the carriage 221. In addition, the second adhesive tape 262 may be pasted as is necessary, which is not illustrated in FIG. 21. In addition, a joint 240C of the ink supply tubes 240 is provided, as necessary.

Figure 22:
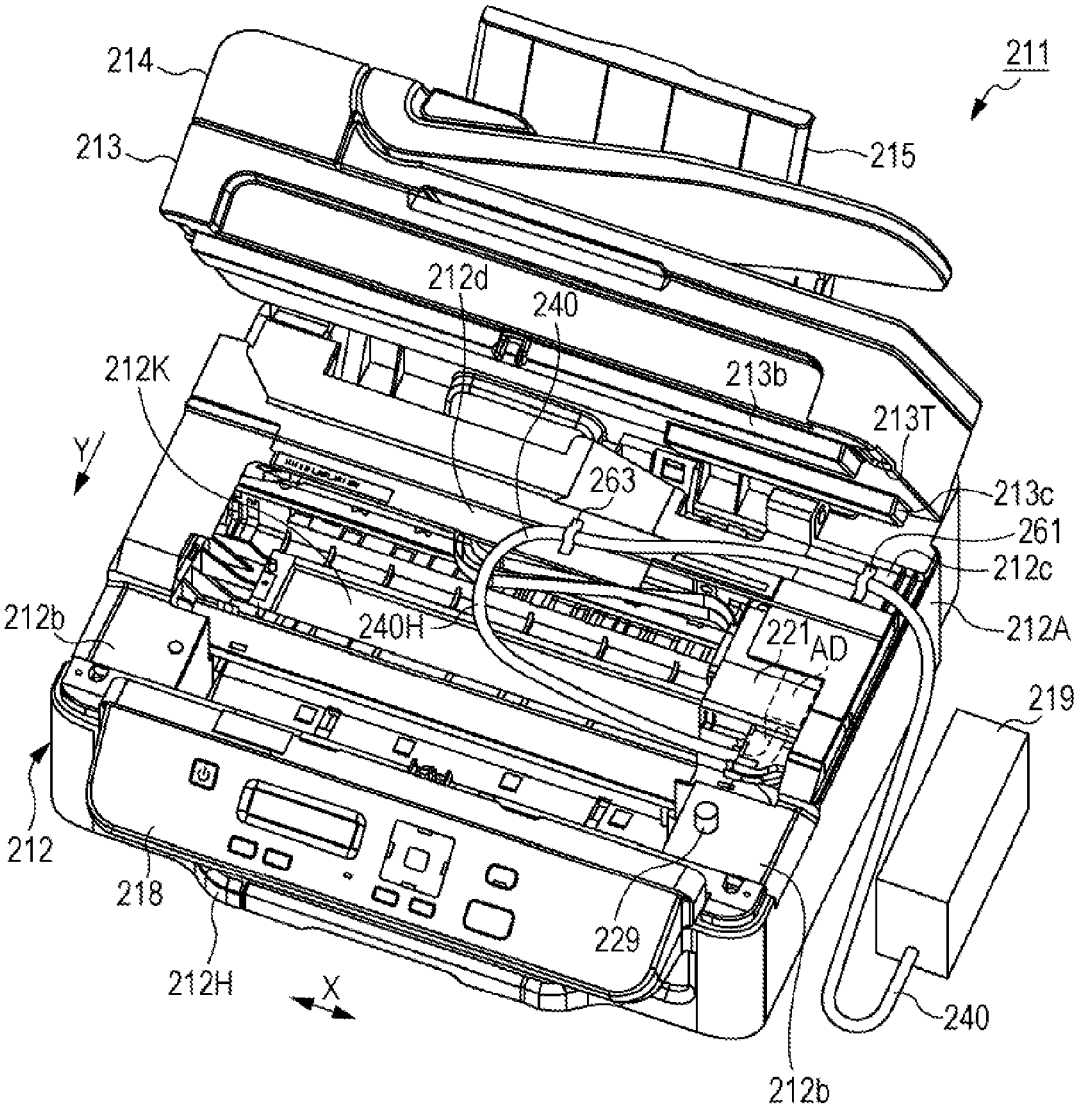
FIG. 22 is a perspective view illustrating a state where the ink supply tubes are fixed to another position according to the ninth embodiment.

Alternately, as illustrated in FIG. 22, the fixing portion may be configured by pasting the third adhesive tape 263 which fixes the ink supply tubes 240 to the housing member positioned on the front side (back side) of the sub-scanning direction Y to the opening portion 212K, among the housing members forming the opening portion 212K.

That is, the ink supply tubes 240 are fixed by the first adhesive tape 261 which is pasted with respect to the housing member of the concave-shaped portion 212*c* which is positioned in the back side to the opening portion 212K. Next, the connection side of the ink supply tubes 240 to the relay adapter AD is fixed by the third adhesive tape 263 which is pasted on the upper surface thereof, with respect to the back-side member 212*d* which forms the opening portion 212K. In the configuration of the fixing portion, the third adhesive tape 263 is pasted on the position corresponding to the substantially center part of the movement region of the carriage 221, in the main scanning direction X. In addition, even if not illustrated, the second adhesive tape 262 is also pasted, as necessary.

As a result, the deformable moving unit 240H formed on the part between the third adhesive tape 263 and the relay adapter AD in the length direction of the ink supply tubes 240, has a curved shape which is comparatively largely curved in the substantially horizontal direction as illustrated in FIG. 22. The joint 240C of the ink supply tubes 240 is provided, in the deformable moving unit 240H as necessary, which is not illustrated in FIG. 22.

Next, the action of the printer 211 in the ninth embodiment will be described.

In the printer 211, by fixing the ink supply tubes 240 to the housing member forming the opening portion 212K by the adhesive tape 260, it is possible to easily form the fixing portion. In addition, by adjusting the paste position of the third adhesive tape 263, it is possible to change the curved shape of the deformable moving unit 240H which performs a follow-up deformation along the movement of the carriage 221.

Furthermore, in a case where the ink supply tubes 240 is removed from the apparatus main body 212 in order to perform the maintenance of the ink supply tubes 240, it is possible to easily remove the ink supply tubes 240 from the apparatus main body 212 by peeling off the adhesive tape 260.

In addition, it is possible to easily fix the ink supply tubes 240 to the printing function unit 212A which is largely exposed, in a state where the image reading unit 213 opens the opening portion 212K of the apparatus main body 212 (printing function unit 212A).

Tenth Embodiment

Next, the configuration of the fixing portion which fixes the ink supply tubes 240 in the tenth embodiment will be described with reference to FIG. 23 and FIG. 24. The fixing portion in the tenth embodiment includes a support member which can be displaced between the first position where the support member is disposed so as to cross the opening portion 212K and the second position where the support member is disposed so as to be spaced away farther from the center position of the opening portion 212K than from the first position as a housing member of the apparatus main body 212 (printing function unit 212A). Then, the fixing portion of the ink supply tubes 240 has a configuration to be provided on the support member of the fixing portion. In the description in FIG. 23 and FIG. 24, the same configuration members as the ninth embodiment and FIG. 19 are referenced by the same numerals, and the description thereof will not be repeated. In addition, the joint 240C of the ink supply tubes 240 is not illustrated in FIG. 23 and FIG. 24.

Figure 23:
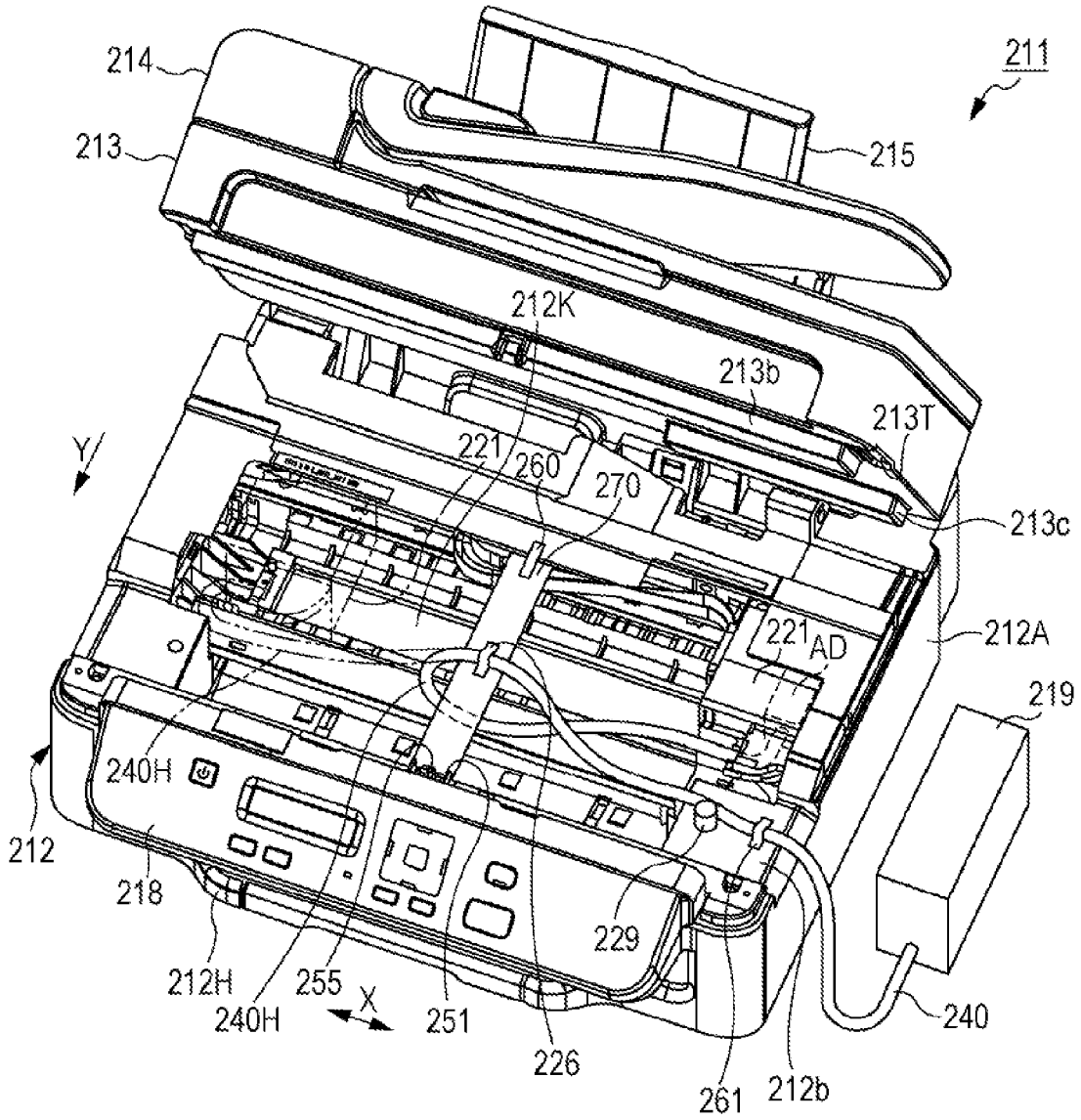
FIG. 23 is a perspective view illustrating a state where the image reading unit is lifted in the printer where the ink supply tubes are fixed according to a tenth embodiment.

As illustrated in FIG. 23, in the upper surface of the printing function unit 212A, the position determination member 251 is fixed, which is fixed on the front side (rear side) of the operation panel unit 218 that is the forward side (front side) of the sub-scanning direction Y, and the rectangular plate shaped support member 270 is rotatably fixed with one end thereof interposed with the position determination member 251. That is, in the support member 270, fixing screws 255 are inserted with respect to the through-hole (not illustrated) as a rotation axis formed on one end side of the longitudinal direction of the support member 270 forming the rectangular plate shape. For this reason, the support member 270 is rotatably (oscillation) mounted with the through-hole as a rotation axis, and the position can be changed by the rotation.

In the present embodiment, in the substantially center part in the longitudinal direction of the support member 270, by a part of the ink supply tubes 240 being fixed by the fixing tool 226, the fixing tool is configured, in which the middle part in the length direction of the ink supply tubes 240 is fixed to the substantially center part of the support member 270. In the present embodiment, the adhesive tape 260 (the third adhesive tape 263) can be used as the fixing tool 226 as similar to the ninth embodiment. Alternately, the fixing member having a locking hook that can be locked to the locking hole (not illustrated) provided on the support member 270 may be used as a fixing tool 226. By the fixing tool 226 like this, a part of the ink supply tubes 240 in the length direction is fixed with respect to the support member 270, by fixing the ink supply tubes 240 to the support member 270 in a state where the ink supply tubes 240 are interposed between the support member 270. As a result, a part of the ink supply tubes 240 in the length direction between the fixing tool 226 and the relay adapter AD is formed as the deformable moving unit 240H which performs a follow-up deformation along the movement of the carriage 221. For example, by interposing the friction plate formed of rubber in the part where the support member 270 and the position determination member 251 are overlapping, it may be configured to suppress the inadvertent oscillation.

Next, the action of the printer 211 in the tenth embodiment will be described with reference to FIG. 23 and FIG. 24.

As illustrated in FIG. 23, in the printer 211 of the present embodiment, when the recording is performed, by the support member 270 disposed so as to cross the opening portion 212K of the printing function unit 212A, the ink supply tubes 240 are fixed on the upper side of the moving carriage 221. In other words, the support member 270 is disposed on the position where the reciprocated movement to the main scanning direction X of the carriage 221 is not interrupted (here, the upper position). In addition, the ink supply tubes 240 fixed by the support member 270 is disposed showing a curved shape which is curved toward the moving direction (left side) of the carriage 221 in the lower side of the support member 270.

By disposing the ink supply tubes 240 in this manner, the curved section portion thereof, at the time of performing the recording, functions as the deformable moving unit 240H which performs a follow-up deformation along the movement of the carriage 221 to the main scanning direction X. That is, as illustrated in FIG. 23 by a two-dot chain line, the deformable moving unit 240H of the ink supply tubes 240 of which one end side is connected to the relay adapter AD mounted on the carriage 221 can easily change the position in the region of the opening portion 212K of the printing function unit 212A.

It is preferable that the support member 270 has a configuration in which the position disposed so as to cross the opening portion 212K may be held as possible. For example, as illustrated in FIG. 23, an end portion opposite to one end side which is the center of rotation (oscillation) in the longitudinal direction thereof may be fixed with respect to the housing member forming the opening portion 212K by the adhesive tape 260 as an example of the fixing tool.

Here, in the printer 211, in a case where the recording operation is stopped to lead to a non-recording time due to the jammed state of the sheet during the transportation, the user causes the support member 270 to rotate (oscillate) using the through-hole as a center of rotation in a direction farther from the center position of the opening portion 212K of the printing function unit 212A.

Figure 24:
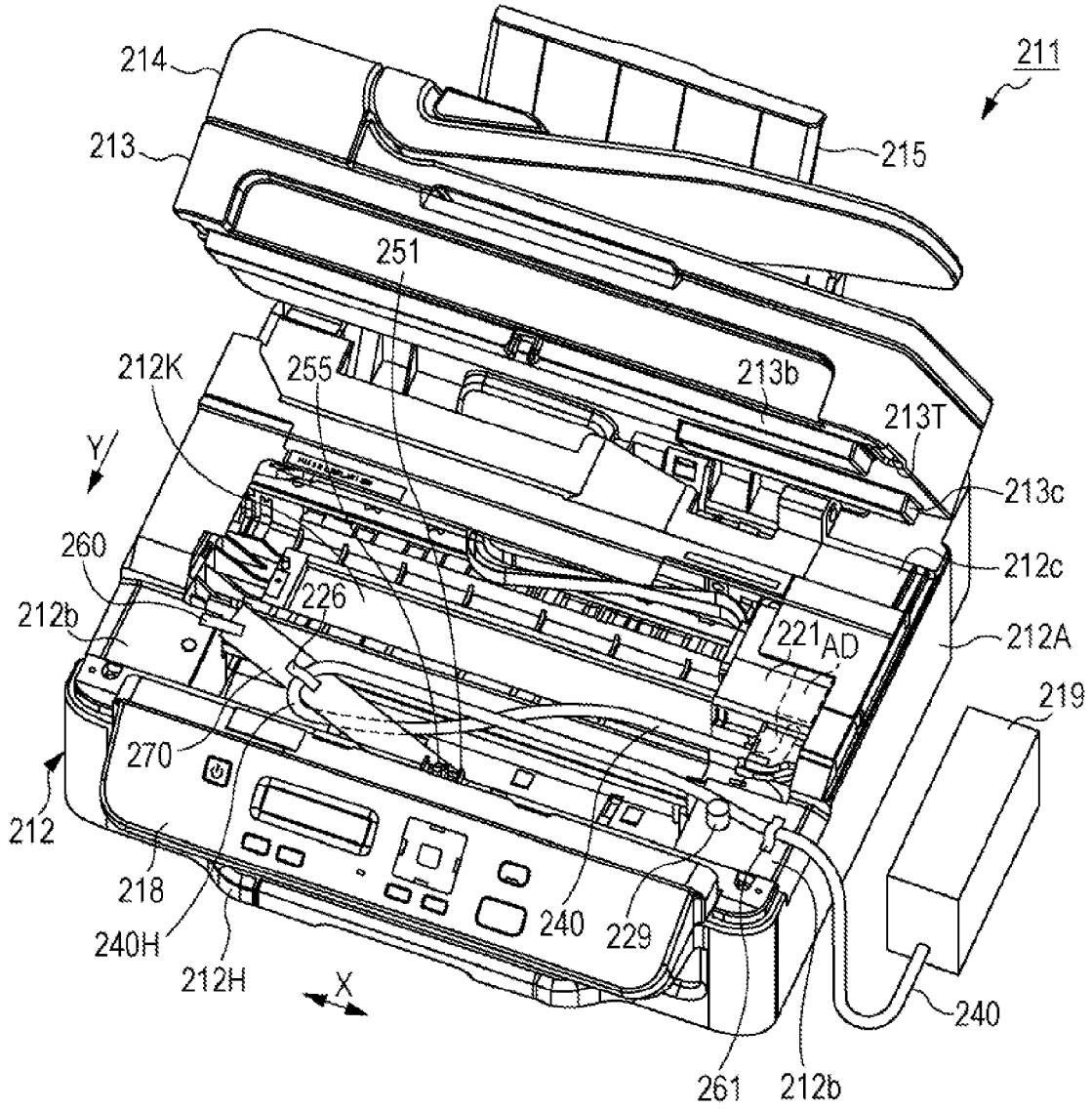
FIG. 24 is a perspective view illustrating a state where a fixing member is displaced according to the tenth embodiment.

That is, as illustrated in FIG. 24, the user peels off the adhesive tape 260, and causes the support member 270 to change the position from the first position where the opening portion 212K of the printing function unit 212A is blocked to the second position where the opening portion 212K is not blocked. In this way, the user can easily insert the finger (hand) into the movement region of the carriage 221 through the opening portion 212K of the printing function unit 212A, and the sheet in the jammed state can easily be removed.

At this time, the frictional resistance in the oscillation direction when the support member 270 is oscillating acts to the support member 270 by the friction plate interposed between the position determination member 251. For this reason, when the user inserts the finger into the carriage 221 through the opening portion 212K of the printing function unit 212A, even in a case where the user removes the hand from the support member 270 which changes the position to the second position, the changed position of the support member 270 is stably held by the frictional resistance acting by the friction plate. Furthermore, in order to stably hold the support member 270 on the changed position (the second position), as illustrated in FIG. 24, the end portion opposite to one end side which is the center of the oscillation in the longitudinal direction of the support member 270 may be fixed to the printing function unit 212A (here, concave-shaped portion 212*b*) by the adhesive tape 260.

After removing the sheet in the jammed state, the user causes the support member 270 to change the position to the first position which crosses the opening portion 212K of the printing function unit 212A. Then, the end portion opposite to one end side which is the center of the oscillation in the longitudinal direction of the support member 270 is fixed with respect to the housing member in the back side which forms the opening portion 212K by the adhesive tape 260 again.

In the above-mentioned ninth embodiment, when the image reading unit 213 rotates (oscillation) in a state of closing the opening portion 212K of the printing function unit 212A, in a case where the projection unit 213*b* and 213*c* projecting to the printing function unit 212A in the swinging direction of the image reading unit 213, it is preferable that the ink supply tubes 240 be disposed at an avoidance position which is not crushed by the projection units 213*b* and 213*c*.

Figure 25:
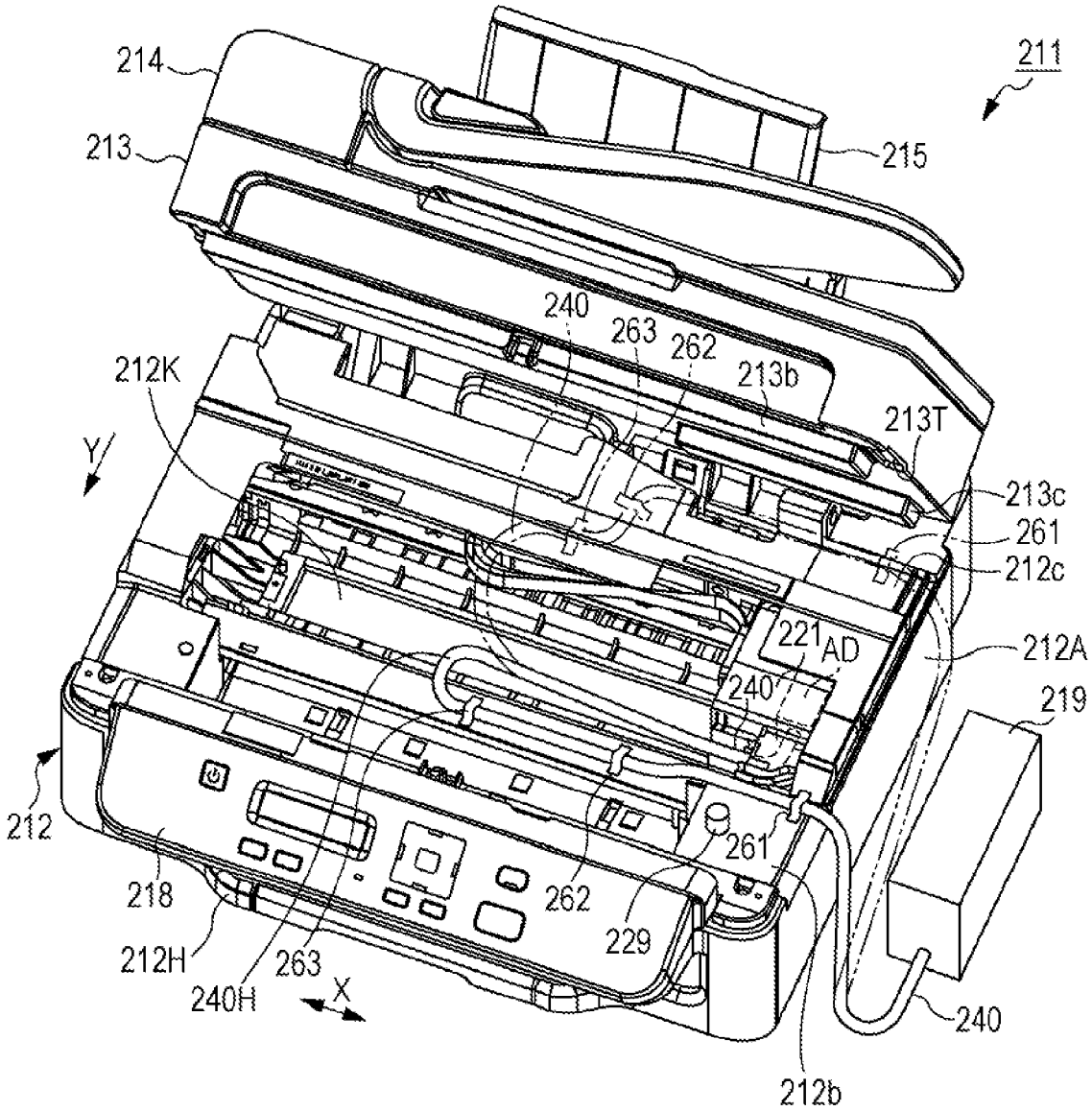
FIG. 25 is a perspective view illustrating a state where the fixed ink supply tubes are disposed to avoid a projection unit provided on the side of the image reading unit.

For example, as illustrated by a solid line or a double dashed line in FIG. 25, when the ink supply tubes 240 are fixed by the adhesive tape 260 in the concave-shaped portion 212*b* or a concave-shaped portion 212*c*, the ink supply tubes 240 fixes the first adhesive tape 261 and the second adhesive tape 262 according to an angle at which the ink supply tubes 240 are formed at a concave-shaped portion 212*b* or at an end corner of the bottom surface of the concave-shaped portion 212*c*. The ink supply tubes 240 disposed at this angle have a high probability to avoid being crushed by the image reading unit 213 (projection unit 213*b* and 213*c*).

That is, the corners of the projection units 213*b* and 213*c* of the image reading unit 213 are formed to be round to be safe even at a user's contact. Therefore, in the concave-shaped portions 212*b* and 212*c*, in corners (corners) rather than the bottom surface portion, it is easy to form a relatively large void between the printing function unit 212A and the image reading unit 213. In FIG. 25, a joint 240C of the ink supply tubes 240 provided as needed is not illustrated.

In the above-mentioned ninth embodiment and the tenth embodiment, the ink supply tubes 240 are described as it is one. However, when a plurality of ink tanks 219 are included in the printer 211, a configuration in which an ink is supplied to the liquid ejecting head 222 side through each of the ink supply tubes 240 from the ink tank 219 side may be provided. As an example, in the tenth embodiment configuring the fixing portion of the ink supply tubes 240 by the support member 270, a case where a plurality of ink supply tubes 240 are arranged will be described referring to FIG. 26.

Figure 26:
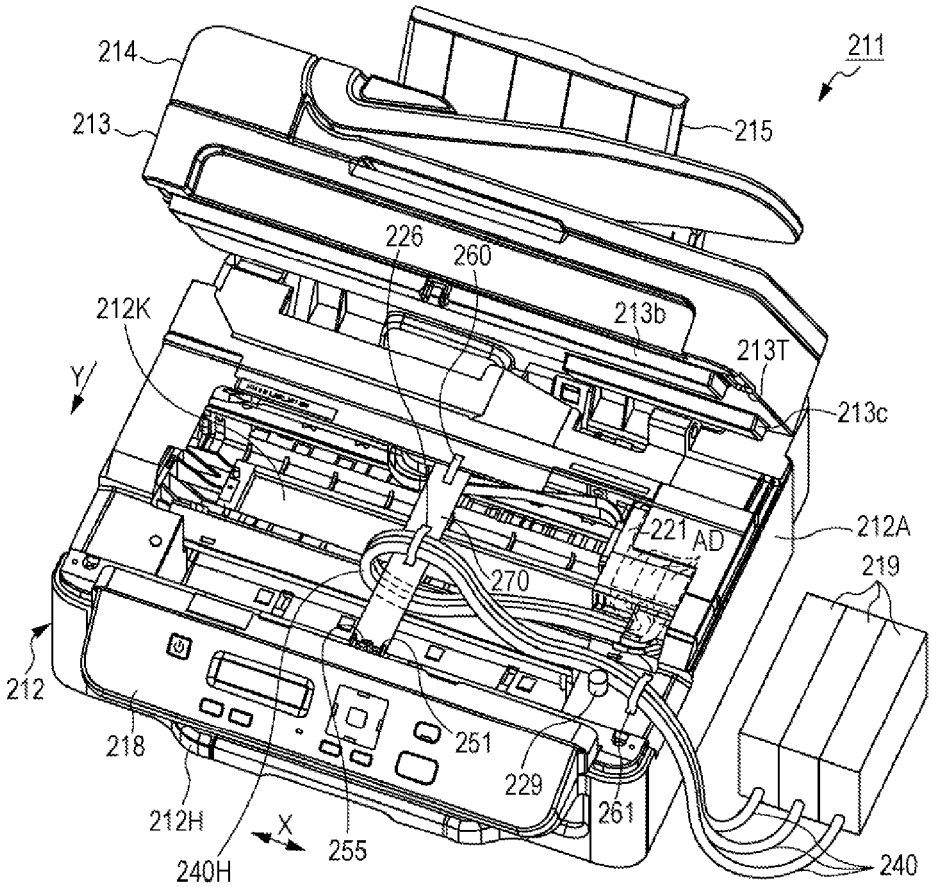
FIG. 26 is a perspective view illustrating a state where a plurality of ink supply tubes is fixed according to the tenth embodiment.

As illustrated in FIG. 26, a plurality (here, three) of ink supply tubes 240 are fixed to the support member 270 by the fixing tool 226 in a parallel state along a plane of the support member 270. The ink supply tubes 240 are fixed in a parallel state along the plane of the support member 270, and accordingly a curved portion formed on the lower side of the support member 270, that is, the deformable moving unit 240H is easily formed following the movement of the carriage 221. The plurality of ink supply tubes 240 can be configured to have tubes connected in parallel with each other, or can be configured to have an individually separated individual tube.

According to the above-mentioned embodiment, the following effects are obtained.

By including the ink supply tubes 240 as much as the number of the ink tanks 219, it is possible to supply an ink to the liquid ejecting head 222 from each ink tank 219.

In the above-mentioned ninth embodiment, a configuration where an additional housing member is attached in addition to the housing member to form the opening portion 212K of the printing function unit 212A, and the ink supply tubes 240 are fixed to the additional housing member may be provided. An example of the configuration will be described referring to FIG. 27.

Figure 27:
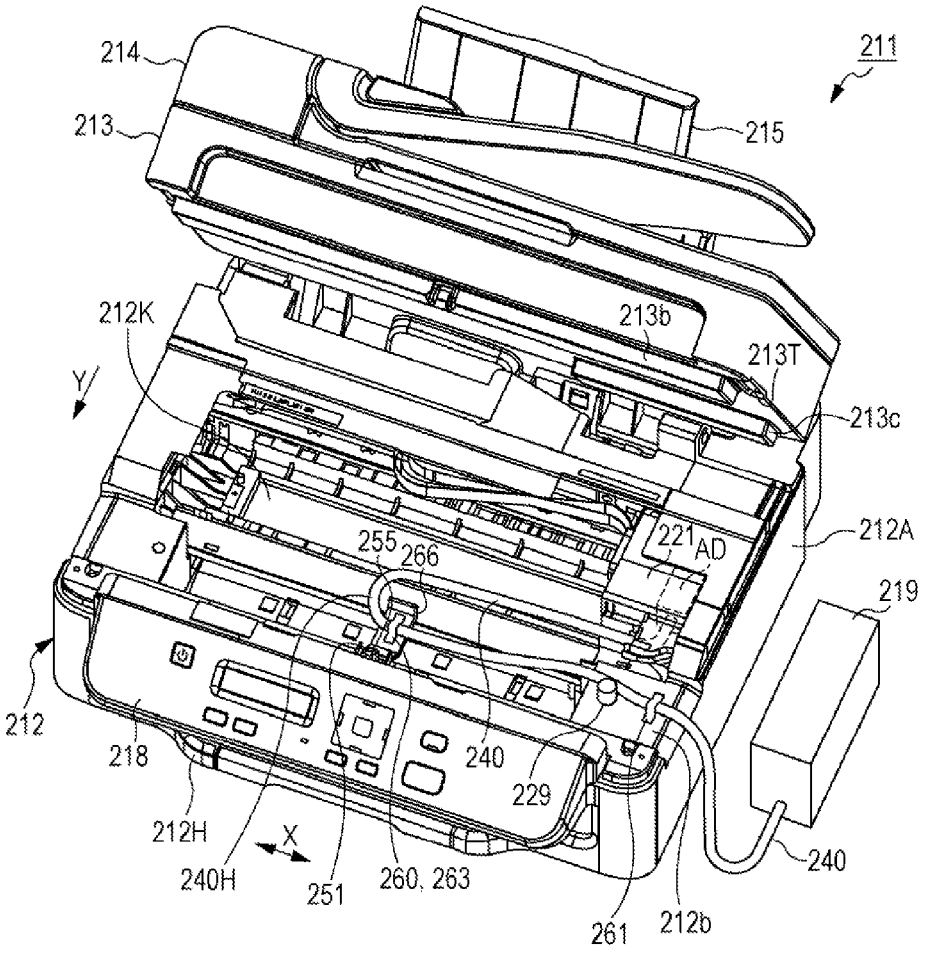
FIG. 27 is a perspective view illustrating a state where the ink supply tubes are fixed to an auxiliary fixing plate according to the tenth embodiment.

As illustrated in FIG. 27, an auxiliary fixing plate 266 formed of a plate shape member as an additional housing member is interposed between the position determination member 251 and the upper surface of the printing function unit 212A to fix a screw, and with respect to the fixed auxiliary fixing plate 266, the ink supply tubes 240 are fixed by pasting adhesive tape 260 (the third adhesive tape 263). The auxiliary fixing plate 266 is fixed to be spaced away from the movement region of the carriage 221 in the horizontal direction, and the image reading unit 213 in a state of closing the opening portion 212K is fixed to be spaced away from the bottom side along with the fixed ink supply tubes 240 in a vertical direction. In the embodiment, the fixed ink supply tubes 240 have a shape bent in a substantially C-shape which is concaved on the bottom side so as to be spaced away from the image reading unit 213 (projection unit 213*b*).

The auxiliary fixing plate 266 may be a flat plate without bending, and there is no problem even if the auxiliary fixing plate 266 is fixed to another position along the main scanning direction X, not a position of the position determination member 251. In addition, when the ink supply tubes 240 are restricted to move to the longitudinal direction and a direction intersecting with the longitudinal direction, the auxiliary fixing plate 266 functions as an example of the fixing tool, so that the third adhesive tape 263 does not need to be pasted.

In the ninth embodiment and the tenth embodiment, the other end side of the ink supply tubes 240 may be configured to be inserted from the outside of the housing at the left side seen from the front side of the sub-scanning direction Y, that is, an opposite and close position to the home position HP in the main scanning direction X of the carriage 221 to the opening portion 212K.

In the above-mentioned embodiment, the ink tanks 19T and 219T as a liquid containing unit are a type which may be refilled, that is, provides an inlet in the ink tanks 19T and 219T. After consuming an ink in the ink tanks 19T and 219T, a configuration in which an ink may be injected from the inlet may be provided, a pack may be exchanged, that is, a bag-like container where an ink is contained is included in the ink tanks 19T and 219T, and when an ink is consumed, the bag-like container may be exchanged. In addition, the ink tanks 19T and 219T may be fixed to the apparatus main bodies 12 and 212, and the apparatus main bodies 12 and 212 may be configured as an additional body, respectively.

An ink contained in the ink tanks 19T and 219T may be a single color only. For example, when printing text characters, black color ink is largely consumed, so that the ink tanks 19T and 219T may contain a black color ink only.

In the above-mentioned embodiment, a target is not limited to a sheet, and fabric, a resin film, a resin sheet, a metal sheet, and the like may be adapted.

In the above-mentioned embodiment, the printers 11, 11A, and 211 may be a liquid ejecting apparatus that ejects or discharges a liquid other than an ink. As a state of liquid discharged from the liquid ejecting apparatus to be a small amount of droplet, those pulling a trail in a granular-shape, a teardrop-shape, a filament-shape are included. In addition, a liquid herein may be any material which may be ejected from the liquid ejecting apparatus. For example, the material may be one in a liquid state, or a fluid-like material such as a liquid with high or low viscosity, sol, gel water, other inorganic or organic solvents, solutions, a liquid resin, a liquid metal (metal melt). In addition, the material intends to include not only a liquid but also those in which particles of a functional material formed of solid matter such as pigment or metal particles are dissolved in a solvent, dispersed or mixed. A typical example of the liquid includes the ink as described in the above-mentioned embodiment, a liquid crystal, and the like. Here, the ink includes a general water-based ink and an oil-based ink, and various types of liquid composition such as gel ink, hot-melt ink, and the like. A specific example of the liquid ejecting apparatus is a liquid ejecting apparatus ejecting a liquid containing materials dispersed or dissolved therein such as an electrode material or a color material used in manufacturing, for example, a liquid crystal display, an electroluminesence (EL) display, a surface emitting display, and a color filter.

In addition, a liquid ejecting apparatus for ejecting a living organic material used in manufacturing a biochip, a liquid ejecting apparatus ejecting a liquid which is a sample used as a precision pipette, a printing device, a microdispenser, and the like may be included. Furthermore, there are also a liquid ejecting apparatus ejecting a lubricant at a pinpoint to a precision machine such as a watch or a camera, and a liquid ejecting apparatus ejecting a transparent resin liquid such as a UV-curing resin in order to form a micro hemispherical lens (optical lens) used in an optical communication element. In addition, a liquid ejecting apparatus is also included which ejects an etching liquid such as acid or alkali to perform etching on a substrate and the like.

The entire disclosure of Japanese Patent Application No. 2012-178149 filed on Aug. 10, 2012, and No. 2012-178152 filed on Aug. 10, 2012 are expressly incorporated by reference herein.

What is claimed is:

1. A liquid ejecting apparatus comprising:

a liquid ejecting head ejecting a liquid to a target;

a housing unit in which a carriage having the liquid ejecting head is disposed to be movable and an opening portion exposing at least a portion of a movement region of the carriage is formed;

a liquid containing unit positioned outside the movement region of the carriage and positioned outside of the housing unit in a state of containing the liquid;

a liquid supply tube which is connected between the liquid containing unit and the liquid ejecting head and has a deformable moving unit which performs a follow-up deformation along a movement of the carriage;

a support member disposed on a position where the movement of the carriage is not interrupted and supporting a portion of the liquid supply tube, wherein the support member is provided to be displaceable in a movement direction of the carriage.

2. The liquid ejecting apparatus according to claim 1, wherein one end side of the support member in a longitudinal direction be attached to be rotatable with respect to the housing unit.

3. The liquid ejecting apparatus according to claim 2, wherein an operation panel unit disposed on the front side of the housing; wherein one end side of the support member is fixed on the side of the operation panel unit.

4. The liquid ejecting apparatus according to claim 2, further comprising:

a fixing portion fixing a portion of the liquid supply tube; wherein the fixing portion fixes a portion supported by the support member in the liquid supply tube.

5. The liquid ejecting apparatus according to claim 1, wherein, in the liquid supply tube, a plurality of tubes are connected to each other through a joint connecting between tubes.

6. The liquid ejecting apparatus according to claim 1, wherein the liquid supply tube is provided one or more than one.

7. The liquid ejecting apparatus according to claim 1, wherein a liquid containing unit disposed at the outer side of the housing unit in a state of containing the liquid ejected by the liquid ejecting head contains a black liquid.

8. The liquid ejecting apparatus according to claim 1, wherein an operation panel unit disposed on the front side of the housing; wherein one end side of the support member is fixed on the side of the operation panel unit.

9. The liquid ejecting apparatus according to claim 8, further comprising:

a fixing portion fixing a portion of the liquid supply tube; wherein the fixing portion fixes a portion supported by the support member in the liquid supply tube.

10. The liquid ejecting apparatus according to claim 1, further comprising:

a fixing portion fixing a portion of the liquid supply tube; wherein the fixing portion fixes a portion supported by the support member in the liquid supply tube.

* * * * *